US011425980B2

(12) United States Patent
Conrad

(10) Patent No.: US 11,425,980 B2
(45) Date of Patent: Aug. 30, 2022

(54) HAIR DRYER

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 239 days.

(21) Appl. No.: 16/837,996

(22) Filed: Apr. 1, 2020

(65) Prior Publication Data

US 2021/0307479 A1 Oct. 7, 2021

(51) Int. Cl.
*A45D 20/12* (2006.01)

(52) U.S. Cl.
CPC ..... *A45D 20/124* (2013.01)

(58) Field of Classification Search
CPC ..... A45D 20/124
USPC ..... 34/97
See application file for complete search history.

(56) References Cited

U.S. PATENT DOCUMENTS 2,314,101 A 3/1943 Phipps
3,364,590 A * 1/1968 Collins ..... A45D 20/46 34/100
3,653,376 A * 4/1972 Martin ..... A45D 19/00 132/202
3,972,126 A 8/1976 DeMuro et al.
4,132,360 A 1/1979 Lee, Jr.
4,210,162 A 7/1980 Dreyer et al.
4,301,601 A * 11/1981 Carr ..... A45D 2/46 34/283
4,419,835 A 12/1983 Strain
5,261,427 A 11/1993 Dolev
5,327,919 A 7/1994 Hanlon
5,490,336 A * 2/1996 Smick ..... A45D 20/12 D28/13
5,528,776 A * 6/1996 Carmichael ..... A45D 19/04 4/518
5,642,570 A * 7/1997 Lee ..... B05B 7/2416 34/98
5,857,262 A * 1/1999 Bonnema ..... F24H 3/0488 431/344

(Continued)

FOREIGN PATENT DOCUMENTS

CN 105686300 A 6/2016
EP 0064405 A1 11/1982

(Continued)

OTHER PUBLICATIONS

International Search Report and Written Opinion, received in connection to co-pending PCT application Mo. PCT/CA2021/050420, dated Jun. 3, 2021.

(Continued)

*Primary Examiner* — Stephen M Gravini
(74) *Attorney, Agent, or Firm* — Philip C. Mendes da Costa; Bereskin & Parr LLP/S.E.N.C.R.L., s.r.l.

(57) ABSTRACT

A hair dryer comprises a primary air flow path extending from an inlet port provided on a first side of the hair dryer and extending to an outlet port, a water collection member located inward of the inlet port wherein hair being dried is directed against a screen positioned forward of the water collection member, whereby ingress of hair into the interior of the primary air flow path is inhibited.

20 Claims, 15 Drawing Sheets

(56) References Cited

U.S. PATENT DOCUMENTS

| | | | | |
|---|---|---|---|---|
| 6,021,584 | A * | 2/2000 | Schwartz | F26B 21/004 34/666 |
| 6,925,728 | B2 | 8/2005 | Busa et al. | |
| 6,959,501 | B1 | 11/2005 | Melzer | |
| 6,973,931 | B1 * | 12/2005 | King | A45D 19/02 132/212 |
| 7,204,038 | B2 * | 4/2007 | Santhouse | A45D 20/12 361/213 |
| 7,984,567 | B2 | 7/2011 | Bertakis | |
| 8,434,238 | B2 * | 5/2013 | Gross | A45D 20/12 132/212 |
| 8,601,713 | B2 * | 12/2013 | Gaillard | A45D 20/12 181/269 |
| 8,782,920 | B2 * | 7/2014 | Marthinsen | A45D 20/12 132/211 |
| 8,893,400 | B2 * | 11/2014 | Carme | A45D 20/42 34/100 |
| 9,144,286 | B2 | 9/2015 | Courtney et al. | |
| 9,173,468 | B2 | 11/2015 | Moloney et al. | |
| 9,185,958 | B2 | 11/2015 | Torres et al. | |
| 9,282,799 | B2 | 3/2016 | Courtney et al. | |
| 9,282,800 | B2 | 3/2016 | Courtney et al. | |
| 9,414,662 | B2 | 8/2016 | Moloney et al. | |
| 9,420,864 | B2 | 8/2016 | Gammack et al. | |
| 9,420,865 | B2 | 8/2016 | Gammack et al. | |
| 9,526,310 | B2 | 12/2016 | Courtney et al. | |
| 9,675,157 | B2 | 6/2017 | Courtney et al. | |
| 9,681,726 | B2 | 6/2017 | Moloney et al. | |
| 9,687,058 | B2 | 6/2017 | Atkinson | |
| 9,713,370 | B2 | 7/2017 | Thomason et al. | |
| 9,808,065 | B2 | 11/2017 | Moloney et al. | |
| 9,808,066 | B2 | 11/2017 | Moloney et al. | |
| 9,808,067 | B2 | 11/2017 | Sutter et al. | |
| 9,936,788 | B2 | 4/2018 | Stephens et al. | |
| 9,936,789 | B2 | 4/2018 | Stephens et al. | |
| 10,010,150 | B2 | 7/2018 | Courtney et al. | |
| 10,016,040 | B2 | 7/2018 | Courtney et al. | |
| 10,021,951 | B2 | 7/2018 | Bobillier et al. | |
| 10,064,470 | B2 | 9/2018 | Warne | |
| 10,076,172 | B2 | 9/2018 | Stephens et al. | |
| 10,117,491 | B2 | 11/2018 | Moloney et al. | |
| 10,165,843 | B2 | 1/2019 | Hedges | |
| 10,165,844 | B2 | 1/2019 | Stephens et al. | |
| 10,194,728 | B2 | 2/2019 | Stephens et al. | |
| 10,213,001 | B2 | 2/2019 | Stephens et al. | |
| 10,226,112 | B2 | 3/2019 | Kerr et al. | |
| 10,555,590 | B2 | 2/2020 | Ohgi et al. | |
| 2003/0172543 | A1 | 9/2003 | Busa et al. | |
| 2007/0180637 | A1 * | 8/2007 | McKay | A46B 17/06 15/22.1 |
| 2013/0160316 | A1 * | 6/2013 | Hadden | A45D 20/16 34/96 |
| 2014/0033558 | A1 * | 2/2014 | Richmond | A45D 1/04 34/97 |
| 2016/0150864 | A1 | 6/2016 | Thomason et al. | |
| 2017/0170709 | A1 | 6/2017 | Barnes et al. | |
| 2019/0380468 | A1 | 12/2019 | Sumerville et al. | |
| 2020/0315311 | A1 | 10/2020 | Hsu | |
| 2021/0000237 | A1 * | 1/2021 | Kennedy | A45D 20/124 |
| 2021/0307472 | A1 * | 10/2021 | Conrad | A45D 20/10 |
| 2021/0307473 | A1 * | 10/2021 | Conrad | A45D 20/12 |
| 2021/0307474 | A1 * | 10/2021 | Conrad | B01D 45/16 |
| 2021/0307478 | A1 * | 10/2021 | Conrad | A45D 20/124 |
| 2021/0307479 | A1 * | 10/2021 | Conrad | A45D 20/122 |

FOREIGN PATENT DOCUMENTS

| | | | |
|---|---|---|---|
| FR | 2504250 | A1 | 10/1982 |
| FR | 2778823 | A1 | 11/1999 |
| JP | 2001190324 | A | 7/2001 |
| JP | 2008148848 | A | 7/2008 |
| KR | 200399142 | Y1 | 10/2005 |
| KR | 10-2015-0135001 | A | 12/2015 |
| WO | 2019/053703 | A1 | 3/2019 |
| WO | 2020094064 | A1 | 5/2020 |
| WO | 2021195760 | A1 | 10/2021 |

OTHER PUBLICATIONS

English machine translation of KR200399142, published on Oct. 19, 2005.
English machine translation of JP2008148848, published on Jul. 3, 2008.
English machine translation of FR2778823, published on Oct. 12, 2001.
English machine translation of KR10-2015-0135001 published on Dec. 2, 2015.
English machine translation of JP2001190324, published on Jul. 17, 2001.
English machine translation of FR2504250, published on Oct. 22, 1982.
English machine translation of CN105686300A, published on Jun. 22, 2016.

* cited by examiner

HAIR DRYER

FIELD

This disclosure relates generally to hair dryers used for drying and styling hair.

INTRODUCTION

The following is not an admission that anything discussed below is part of the prior art or part of the common general knowledge of a person skilled in the art.

Conventional hair dryers employ a flow of room air that is directed towards the hair of a person to dry the hair. The room air may optionally be heated so as to accelerate the drying process. This process relies primarily upon the evaporation of water from the hair as the mechanism of drying. Tools, such as combs, brushes, curlers, or straightening plates may be used in conjunction with a conventional hair dryer, or may optionally be permanently or replaceably affixed to a conventional hair dryer to enable the hair to be styled while it is dried.

Conventional hair dryers primarily rely upon the evaporation of water from the hair as the mechanism of drying. Accordingly, air is heated to reduce the relative humidity of the air, and allow the heated air to absorb more moisture per unit weight of air. Hair dryers use various designs to blow a large volume of heated air towards the hair to be dried, but only a small portion of the energy input into the dryer may actually contact wet hair and remove moisture from the hair. As such this is a very energy inefficient process. For example, dry human hair which weighs 0.2 to 0.6 pounds may absorb 0.1 to 0.3 pounds of water. The specific heat capacity of hair is about 0.4 btu/lb/° F., and the specific heat capacity of water is 1 btu/lb/° F. It takes about 974 btu per pound to evaporate water. Therefore, evaporating 0.1 to 0.3 pounds of water only requires about 109 btu (32 Whrs) to 325 btu (95 Whrs).

Healthy hair will typically absorb about 30% to 35% of its own weight of water causing a change of about a 15% to 20% in the diameter of the hair and about a 2% change in the length of the hair. Damaged hair will typically absorb about 42% to 48% of its own weight of water causing a change of about 18% to 23% in diameter and about 2% in length. While different types of hair do exhibit different levels of water absorption, hair loses about 20% to 50% of its tensile strength when wet with curly hair losing the most and thereby becoming the weakest. These properties depend on cuticle and sebum of the particular hair.

A consequence of hair losing its tensile strength when saturated with water is that it may break when combed or brushed, as well as being more prone to tangling due to the slightly raised cuticle surface that is typical for wet hair. The regular expansion and contraction that occurs when hair is wetted and dries, such as when being washed, causes regular damage due to uneven shrinking which occurs during the drying process under normal conditions and especially when a conventional hair dryer is used as the mechanical stress on the surface of and inside the cortex of hair strands results in gradual fatigue of the fiber, which can lead to fatigue failure (breakage). Hair damage and breakage is often characterized as cuticle breakage, mid-strand fracture, and splitting.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

Accordingly, a hair dryer has at least two operating modes. In a first mode, hair is dried by drawing air through the hair and into the hair dryer. This mode may be used to remove 50-80 wt. % or 60-70 wt. % of the water in the hair. Subsequently, in a second operating mode, heated air is provided to further dry the hair. The heated air may remove 20-50 wt. % or 30-40 wt. % of the water from the hair.

One advantage of this embodiment is that a substantial portion or a majority of the water may be removed without the application of heat. Accordingly, the hair dryer may be more energy efficient as compared to a conventional hair dryer since less heated air is used. A further advantage is that the time required to dry hair may be reduced as compared to a conventional hair dryer since some of the water is removed by drawing ambient air through the hair and essentially sucking some of the water from the hair. A further advantage is that, as less heat is applied, and as the heat may be applied after a substantial amount of water is removed from the hair, less hair damage may occur.

Accordingly, as discussed, a hair dryer may employ different modes of water removal when the hair is fully saturated versus when it less saturated or almost dry. After a user has washed their hair, and optionally partially dried it with a towel, the user may employ the first mode of the hair dryer by positioning the intake side of the hair dryer to the hair. The intake side of the drying dryer may comprise a porous member such as a porous screen, fine woven mesh, or an open cell foam such as open cell polyurethane or any combination thereof. The porous member enables sub-atmospheric pressure to be applied over a wide area of the hair yet inhibit or prevent individual hairs or groups of hairs from being drawn into the hair dryer but permit water from the hair to be drawn into the hair dryer.

The water drawn into the hair dryer may be ejected as small droplets and/or, collected by a water trap or a water collection member that may be placed, e.g., in the intake air stream, adjacent to an air moving member, in the exhaust airstream of the air moving member, or at an air outlet port of the hair dryer, or a combination thereof. Optionally, the water collection member collects water in its liquid form and sequesters the water so as to reduce, inhibit or substantially prevent the sequestered water being evaporated thereby removing the requirement to provide sufficient latent heat of evaporation to the captured and segregated water to evaporate the water.

The water collection member may be an open cell foam. In such a case, water absorbed by the open cell foam may be removed by compressing the open cell foam, withdrawing the open cell foam for drying or replacement with a drier open cell foam, or enabling air to flow through the open cell foam to evaporate water retained therein. Such air flow may occur during the drying of hair and/or subsequently when the hair is dried and, e.g., the hair dryer is placed in a stand or the like.

If the water collection member is a container in which water is sequestered, then the container may be emptied by removing the container or opening a drainage port when the container is on board the hair dryer or has been removed from the hair dryer.

The use of sub-atmospheric pressure to withdraw water from hair requires less energy than the latent heat of evaporation required to evaporate all of the water in the hair. The reduced energy requirement of the hair dryer may enable the hair dryer to operate part time or full time using on board portable energy storage members such as primary batteries, rechargeable batteries, super-capacitors, fuel cells or hydrogen combustion engines or turbines to power the device. Accordingly, the hair dryer may be cordless. An optional cord may be provided to enable the hair dryer to also or alternately operate using household current. An advantage is using a cord is that the portable energy storage members may be recharged on board.

Optionally, during the first mode and/or during the second mode, a heated member (e.g., a resistively heated member) may be in contact with the hair from which moisture us being withdrawn by sub-atmospheric pressure so as to further accelerate the drying process. Alternately, or in addition, heat may be directed towards the hair, such as by an infrared heat emitting member.

During the first mode of operation, heated air may be provided to the hair being dried. Accordingly, sub-atmospheric pressure may be used by itself or in combination with heated air that may be directed at a location in front of the inlet port that provides the sub-atmospheric pressure. The heated air may be applied concurrently all of the time during the provision of the sub-atmospheric pressure or only part of the time that the sub-atmospheric pressure is provided. For example, the heated air may be applied after the sub-atmospheric pressure has been provided for a first period of time. The air may be heated by passing the air across the motor of a motor and fan assembly so as to cool the motor. Alternately, or in addition, a heating element (e.g., a resistively heated member) may be provided downstream of the motor and upstream of an air outlet port.

It will be appreciated that an air flow multiplier may be used to provide increased air flow to the hair being dried. The air flow multiplier may be any design that induces air to flow along a surface or through a channel, and may employ the Coanda effect and/or may use an air foil. The increased air flow may be merged with an air flow stream travelling in a passage that is downstream from an air moving member (a motor and fan assembly), e.g., the merged stream exits the hair dryer through a common outlet port or ports, and/or the increased air flow may be separately directed at the hair being dried. It will be appreciated that the increased air flow may be heated by a heating element as discussed previously. If the increased air flow is separately directed at the hair being dried, such as by passing through its own channel, the increased air flow may be heated by a separate heating element.

Once the sub-atmospheric pressure has been used to remove as much water as desired, the user may then employ the second mode of the hair dryer disclosed herein by directing the air, optionally heated air, over the hair to enable evaporative drying of the hair. The air may be heated by using waste heat from the motor (using the air stream to cool the motor before the air is directed at the hair of a user), energizing a heating element in the air flow path from the air moving member to the outlet port, energizing a heating element in an air flow path of an air flow multiplier or a combination thereof.

Optionally, such a heating element may be automatically engaged when a sensor sends a signal indicative that the user has completed the first mode of operation. The sensor may be a pressure sensor. Accordingly, when the sub-atmospheric pressure rises above a particular level for a period of time indicating that the user no longer has the hair dryer in contact with the hair. Alternately or in addition, the sensor may be a proximity sensor. The proximity sensor may be used to sense the position of the hair dryer relative to the user and send a signal that energizes the heating element or causes the heating element to be energized. Accordingly, for example, the user may move the hair dryer away from the hair once some of the water has be removed thereby increasing the air flow through the air mover due to the reduced restriction on the system and changing the use of the hair drying device to the second mode of operation pursuant to which heated air may then be automatically produced by the hair dryer.

It will be appreciated that the heated air may be emitted from the same side of the hair dryer that provides the sub-atmospheric pressure or an alternate (e.g., axially opposed) side of the hair dryer.

It will be appreciated that if air is directed at the hair during the first mode of operation of the hair dryer, that the same air stream may be heated or automatically heated by moving the hair dryer sufficiently away from the head of a user to cause the sensor to emit a signal that energizes the heating element. Accordingly, the second mode of operation may be achieved by moving the hair dryer away from the head of a person.

Optionally, a sensor and a feedback control system for the heating element or heating elements may be used to control the exit temperature of air from the hair dryer. The sensor may be a temperature sensor that senses the temperature of the heated air stream and/or the temperature of the hair of a person whose hair is being dried. For example, a thermal sensor and/or thermal camera may be employed to reset the set-point of the control system for the heating element or heating elements to ensure that the hair being dried is not overheated. Alternately, or in addition, a distance sensor such as a small Lidar or ultrasonic sensor may optionally be used to determine the distance of the hair dryer to the hair of the user so as to reset the set-point of the temperature sensor and feedback control system for the heating element or heating elements to ensure that the hair being dried is not overheated.

The hair dryer disclosed requires less heat energy than conventional hair dryers and allows a person's hair to be dried or styled by blowing less hot air onto the hair than a conventional hair dryer, and doing so in a shorter amount of time than required with conventional dryers. Therefore, the hair and the scalp are not damaged or the damage may be reduced, and blood circulation in the capillary vessels of the scalp may be promoted. Accordingly, hair may be keep healthy and shiny.

A further advantage is that, since the heating element may be designed to produce less heat, the heating element may be smaller and therefore the hair dryer may be more compact.

Another advantage of a hair dryer having a reduced power requirement is that it enables cordless operation and/or the use of a higher gauge electric cord, with the option of a swivel power connection, to improve the ease of use of the product.

Another advantage of the hair dryer disclosed is that if curlers, hair flattening devices, or other styling aide is applied to the hair after the first mode of drying using sub-atmospheric pressure to draw water from the hair, and before the second mode of use employing evaporative drying, the time required to dry and style hair is significantly reduced because the amount of energy transfer required is reduced.

In accordance with one aspect of this disclosure, there is provided a hair dryer comprising:

(a) a primary air flow path extending from an inlet port provided on a first side of the hair dryer and extending to an outlet port;

(b) an air moving member provided in the primary air flow path;

(c) the inlet port comprises a screen, whereby ingress of hair into the interior of the primary air flow path is inhibited; and, (d) a water collection member located inward of the inlet port.

In any embodiment, the water collection member may comprise a water absorbing member.

In any embodiment, the water absorbing member may be removably mounted in the hair dryer.

In any embodiment, the water absorbing member may comprise a sponge.

In any embodiment, the water collection member may comprise a collection container with an openable outlet port.

In any embodiment, outlet port may be provided on a second side of the hair dryer and the second side may be axially opposed to the first side.

In any embodiment, the air moving member may comprise a motor and fan assembly that is operable in a high suction mode and in a high air flow mode.

In any embodiment, in the high suction mode, a fan blade of the motor and fan assembly may be in a high suction mode position in which the fan blade is positioned a first distance downstream from a fan blade cowling and, in the high air flow mode, the fan blade may be in a high air flow mode positon in which the fan blade is positioned a second distance downstream from a fan blade cowling wherein the second distance is greater than the first distance.

In any embodiment, the hair dryer may further comprise a handle that is movingly mounted to the body, the handle may be moveable from a high suction mode position to a high air flow mode position, the handle is drivingly connected to the fan and motor assembly whereby, as the handle is moved from the high suction mode position to the high air flow mode position, the fan blade is moved from the high suction mode position to the high air flow mode position.

In any embodiment, the hair dryer may further comprise a water discharge port, the water discharge port may be positioned downstream from the water collection member and the air moving member.

In any embodiment, the hair dryer may further comprise a redirecting member operable between a first position in which a first volume of air travels from the primary inlet port to the primary outlet port and a second position in which at least some of the first volume of air is redirected to travel through a secondary air flow path having a secondary outlet port provided at the first side of the hair dryer.

In any embodiment, the secondary outlet port may comprise a plurality of secondary air outlets positioned around the inlet port. The plurality of secondary air outlets may direct air inwardly towards a center of the inlet port.

In any embodiment, the hair dryer may further comprise a heating element in the secondary air flow path.

In any embodiment, the hair dryer may further comprise an infrared heating element that, in operation, directs infrared heat to a location forward of the inlet port.

In any embodiment, the hair dryer may further comprise a lighting member providing a first illumination effect when the air moving member is actuated and air is drawn in through the inlet port and a second illumination effect when the air moving member is actuated and air is drawn in through the inlet port and when the heating element is actuated.

In any embodiment, the hair dryer may further comprise a lighting member providing a first illumination effect when the air moving member is actuated and air is drawn in through the inlet port, a second illumination effect when the air moving member is actuated and air is drawn in through the inlet port and when the heating element in the secondary air flow path is actuated, and a third illumination effect when the air moving member is actuated and air is drawn in through the inlet port and when the infrared heating element is actuated.

In any embodiment, the hair dryer may further comprise a secondary air flow path having a secondary inlet port downstream from the air moving member and secondary outlet port provided at the first side of the hair dryer.

In accordance with another aspect of this disclosure, there is provided a hair dryer comprising:

(a) a primary air flow path extending from an inlet port provided on a first side of the hair dryer and extending to an outlet port provided on a second side of the hair dryer;

(b) an air moving member provided in the primary air flow path;

(c) the inlet port comprises a screen, whereby ingress of hair into the interior of the primary air flow path is inhibited; and, (d) a heating element positioned in the primary air flow path between the air moving member and the outlet port.

In any embodiment, the hair dryer may further comprise a sensor operably connected to the heating element wherein the heating element may be deactivated when the sensor detects hair proximate the first side and the heating element may be activated when the sensor does not detect hair proximate the first side.

In any embodiment, the sensor may comprise a proximity sensor.

In any embodiment, the sensor may comprise a pressure sensor.

In any embodiment, the hair dryer may further comprise a lighting member providing a first illumination effect when the air moving member is actuated and the heating element is off and a second illumination effect when the air moving member is actuated and the heating element is actuated.

In any embodiment, the hair dryer may further comprise a temperature sensor operably connected to the heating element to maintain a temperature of hair being dried to less than 70° C.

In any embodiment, the temperature sensor may be operably connected to the heating element to maintain a temperature of air exiting the outlet port to less than 70° C.

In any embodiment, the hair dryer may further comprise a temperature sensor operably connected to the heating element to maintain a temperature of hair being dried to less than 60° C.

In any embodiment, the temperature sensor may be operably connected to the heating element to maintain a temperature of air exiting the outlet port to less than 60° C.

In any embodiment, the hair dryer may further comprise a water collection member located inward of the inlet port.

In any embodiment, the water collection member may comprise a water absorbing member.

In any embodiment, the water absorbing member may be removably mounted in the hair dryer.

In any embodiment, the water absorbing member may comprise a sponge.

In any embodiment, the water collection member may comprise a collection container with an openable outlet port.

In any embodiment, the second side may be an axially opposed to the first side.

In any embodiment, the hair dryer may further comprise an air flow multiplier provided on the second side of the hair dryer.

In any embodiment, the air flow multiplier may comprise an air foil having a downstream side proximate the outlet port.

In any embodiment, the air flow multiplier may comprise a surface that induces a Coanda effect flow along the surface.

In accordance with another aspect of this disclosure, there is provided a hair dryer comprising:

(a) a primary air flow path extending from a primary inlet port provided on a first side of the hair dryer and extending to a primary outlet port provided on a second side of the hair dryer, (b) an air moving member provided in the primary air flow path;

(c) the primary inlet port comprises a screen, whereby ingress of hair into the interior of the primary air flow path is inhibited;

(d) a secondary air flow path extending from a location in the primary air flow path to a secondary outlet port provided on the first side of the hair dryer; and, (e) a redirecting member operable between a first position in which a first volume of air travels from the primary inlet port to the primary outlet port and a second position in which at least some of the first volume of air is redirected to travel through the secondary air flow path.

In any embodiment, the secondary outlet port may comprise a plurality of secondary air outlets positioned around the inlet port.

In any embodiment, the plurality of secondary air outlets may direct air inwardly towards a center of the inlet port.

In any embodiment, the hair dryer may further comprise a heating element in the secondary air flow path. Optionally, a lighting member may provide a first illumination effect when the air moving member is actuated and air is drawn in through the inlet port and a second illumination effect when the air moving member is actuated and air is drawn in through the inlet port, the air directing member is in the second position and the heating element is actuated. The first illumination effect may comprise a first color light being emitted and the second illumination effect may comprise a second color light being emitted wherein the second color differs to the first color.

In any embodiment, the hair dryer may further comprise a heating element in the secondary air flow path and an infrared heating element that, in operation, directs infrared heat to a location forward of the inlet port. Optionally, a lighting member may provide a first illumination effect when the air moving member is actuated and air is drawn in through the inlet port, a second illumination effect when the air moving member is actuated and air is drawn in through the inlet port, the air directing member is in the second position and the heating element in the secondary air flow path is actuated, and a third illumination effect when the air moving member is actuated and air is drawn in through the inlet port and the infrared heating element is actuated. The first illumination effect may comprise a first color light being emitted and the second illumination effect may comprise a second color light being emitted wherein the second color differs to the first color and the third illumination effect may comprise a third color light being emitted wherein the third color differs to the first color and the second color.

In any embodiment, the hair dryer may further comprise an infrared heating element that, in operation, directs infrared heat to a location forward of the inlet port. Optionally, alighting member may provide a first illumination effect when the air moving member is actuated and air is drawn in through the inlet port and a second illumination effect when the air moving member is actuated and air is drawn in through the inlet port and when the infrared heating element is actuated. The first illumination effect may comprise a first color light being emitted and the second illumination effect may comprise a second color light being emitted wherein the second color differs to the first color.

In any embodiment, the air moving member may comprise a motor and fan assembly that may be operable in a high suction mode and in a high air flow mode. Optionally, in the high suction mode, a fan blade of the motor and fan assembly is in a high suction mode position in which the fan blade is positioned a first distance downstream from a fan blade cowling and, in the high air flow mode, the fan blade is in a high air flow mode positon in which the fan blade is positioned a second distance downstream from a fan blade cowling wherein the second distance is greater than the first distance. In such an embodiment, that hair dryer may further comprise a handle that is movingly mounted to the body, the handle may be moveable from a high suction mode position to a high air flow mode position, the handle is drivingly connected to the fan and motor assembly whereby, as the handle is moved from the high suction mode position to the high air flow mode position, the fan blade is moved from the high suction mode position to the high air flow mode position.

In any embodiment, the air moving member may comprise a motor and fan assembly having a motor, a first fan blade assembly and a second fan blade assembly, the first fan blade assembly may be positioned between the inlet port and the motor and produces a first level of suction and the second fan blade assembly may be positioned between the motor and the primary outlet port and produces a second level of suction wherein the second level of suction may be less than the first level of suction.

In any embodiment, the air moving member may comprise a motor and fan assembly having a motor, a first fan blade assembly and a second fan blade assembly, the first fan blade assembly may be positioned between the inlet port and the motor and produces a first volume of air flow and the second fan blade assembly may be positioned between the motor and the primary outlet port and produces a second volume of air flow, wherein the second volume of air flow may be higher than the first volume of air flow.

In any embodiment, the air moving member may comprise a motor and fan assembly having a motor, a first fan blade assembly and a second fan blade assembly, the first fan blade assembly may be a high suction fan blade assembly and the second fan blade assembly may be a high volume fan blade assembly.

In any embodiment, the hair dryer may further comprise a heating element upstream of the primary outlet port and a temperature sensor operably connected to the heating element to maintain a temperature of hair being dried to less than 70° C.

In any embodiment, the hair dryer may further comprise a heating element upstream of the primary outlet port and a temperature sensor operably connected to the heating element to maintain a temperature of hair being dried to less than 60° C.

In accordance with another aspect of this disclosure, there is provided a hair dryer comprising:

(a) a primary air flow path extending from an inlet port provided on a first side of the hair dryer and extending to an outlet passage terminating at an outlet port;

(b) an air moving member provided in the primary air flow path;

(c) the inlet port comprises a screen, whereby ingress of hair into the interior of the primary air flow path is inhibited; and, (d) an air flow multiplier provided adjacent the outlet passage.

In any embodiment, the air flow multiplier may comprise an air foil having a downstream side proximate the outlet port.

In any embodiment, the air flow multiplier may comprise a surface that induces a Coanda effect flow along the surface.

In any embodiment, the hair dryer may further comprise a supplemental air flow passage extending to a position proximate the outlet port wherein at least one sidewall of the supplemental passage may comprise an air foil. Optionally, a heating element may be positioned in the supplemental air flow passage.

In any embodiment, the hair dryer may further comprise a supplemental air flow passage extending to a position proximate the outlet port wherein a portion of air flow induced by the air moving member is directed through the supplemental air flow passage. Optionally, a heating element may be positioned in the supplemental air flow passage.

In any embodiment, the hair dryer may further comprise a heating element positioned in the primary air flow path between the air moving member and the outlet port. Optionally a sensor may be operably connected to the heating element wherein the heating element may be deactivated when the sensor detects hair proximate the first side and the heating element may be activated when the sensor does not detect hair proximate the first side. The sensor may comprise a proximity sensor and/or a pressure sensor.

In any embodiment, the heating element may be powered by an onboard energy storage member.

In any embodiment, the hair dryer may further comprise a temperature sensor operably connected to the heating element to maintain a temperature of hair being dried to less than 70° C.

In any embodiment, the temperature sensor may be operably connected to the heating element to maintain a temperature of air exiting the outlet port to less than 70° C.

In any embodiment, the hair dryer may further comprise a temperature sensor operably connected to the heating element to maintain a temperature of hair being dried to less than 60° C.

In any embodiment, the temperature sensor may be operably connected to the heating element to maintain a temperature of air exiting the outlet port to less than 60° C.

In any embodiment, the hair dryer may further comprise a water collection member located inward of the inlet port.

In any embodiment, the water collection member may comprise a water absorbing member.

In any embodiment, the water absorbing member may be removably mounted in the hair dryer.

In any embodiment, the outlet port may be provided on a second side of the hair dryer that is axially opposed to the first side.

In accordance with another aspect of this disclosure, there is provided a method comprising:

(a) drawing air through the hair of the user and into an inlet port of a hair dryer; and, (b) subsequently directing air from the hair dryer to the hair of the user.

In any embodiment, the air that is drawn into the hair dryer may comprise ambient air.

In any embodiment, the air that is drawn into the hair dryer is ambient air.

In any embodiment, the method may further comprise producing a redirected air stream by directing at least some of the air drawn into the air dryer in step (a) to a location in front of the inlet port.

In any embodiment, the method may further comprise heating the redirected air stream.

In any embodiment, the method may further comprise inhibiting hair from entering into the hair dryer.

In any embodiment, from 50-80 wt. % of water in the hair may be removed in step (a).

In any embodiment, from 20-50 wt. % of water in the hair may be removed in step (b).

In any embodiment, from 60-70 wt. % of water in the hair may be removed in step (a).

In any embodiment, from 30-40 wt. % of water in the hair may be removed in step (b).

In any embodiment, the air directed at the hair in step (b) may be heated.

In any embodiment, a temperature of the air that is directed at the hair may be adjusted to maintain a temperature of the hair below 70° C.

In any embodiment, the temperature of the hair may be monitored and heat emitted by the heating element may be reduced if the temperature of the hair increases above 70° C.

In any embodiment, a temperature of the air directed at the hair in step (b) may be monitored and heat emitted by the heating element may be reduced if the temperature of the air increases above 70° C.

In any embodiment, the method may further comprise monitoring when the hair is not positioned in front of the inlet port and actuating a heating element to heat the air directed at the hair in step (b) when the hair is not positioned in front of the inlet port and the hair dryer is actuated.

In any embodiment, the method may further comprise monitoring the pressure in the hair dryer upstream of the inlet port and actuating a heating element to heat the air directed at the hair in step (b) when the pressure drops below a predetermined level and the hair dryer is actuated.

In any embodiment, the method may further comprise using a proximity sensor to sense a person in front of the inlet port and actuating a heating element to heat the air directed at the hair in step (b) when the proximity sensor detects a person is not in front of the inlet port and the hair dryer is actuated.

In accordance with another aspect of this disclosure, there is provided a method comprising:

(a) drawing air through the hair of the user and into a first inlet port provided on a first side of a hair dryer;

(b) withdrawing moisture from the air entering the first inlet port; and, (c) directing an air stream through a first outlet port of the hair dryer to the hair of the user.

In any embodiment, the method may further comprise inhibiting hair from entering into the hair dryer.

In any embodiment, at least some of the air that is drawn into the first inlet port in step (a) may be redirected to produce the air stream of step (c).

In any embodiment, the method may further comprise heating the air stream whereby step (c) may comprise directing a heated air stream from the hair dryer to the hair of the user.

In any embodiment, step (c) may occur subsequent to step (a).

In any embodiment, step (a) may be conducted for a first period of time and the heated air stream may be directed to the hair of the user for a second period of time wherein the second period of time may differ to the first period of time. Optionally, the second period of time may be shorter than the first period of time.

In any embodiment, the hair dryer may further comprise an energizable heating element, steps (a) and (c) commence concurrently and subsequently the energizable heating element may be energized whereby step (c) further comprises directing a heated air stream from the hair dryer to the hair of the user.

In any embodiment, the temperature of the hair may be monitored and heat emitted by the heating element may be reduced if the temperature of the hair increases above 70° C.

In any embodiment, a temperature of the air directed at the hair in step (c) may be monitored and heat emitted by the heating element may be reduced if the temperature of the air increases above 70° C.

In any embodiment, from 50-80 wt. % of water in the hair may be removed in prior to the energizable heating element being energized.

In any embodiment, the first inlet port and the first outlet port may be on one side of the hair dryer and the method may further comprise redirecting at least some of the air drawn into the first inlet port in step (a) to exit the first outlet port in step (c).

In any embodiment, the first inlet port and the first outlet port may be on one side of the hair dryer, a second inlet port that is upstream of the first outlet port may be provided on a second side of the hair dryer and the method may further comprise drawing from the second inlet port to exit the first outlet port in step (c).

In any embodiment, the method may further comprise heating air entering the second inlet port whereby step (c) may comprise directing a heated air stream from the hair dryer to the hair of the user.

In any embodiment, the hair dryer may further comprise an energizable heating element, steps (a) and (c) may commence concurrently and subsequently the energizable heating element may be energized whereby step (c) may further comprise directing a heated air stream from the hair dryer to the hair of the user. Optionally, from 50-80 wt. % of water in the hair may be removed in prior to the energizable heating element being energized.

In any embodiment, the method may further comprise directing air entering the first inlet port to a second outlet port that is downstream from the first inlet port. Optionally, the air exiting the second outlet port is directed away from the first side of the hair dryer.

In any embodiment, a temperature of the hair may be monitored and heat emitted by the heating element may be reduced if the temperature of the hair increases above 70° C.

In any embodiment, a temperature of the air directed at the hair in step (c) may be monitored and heat emitted by the heating element may be reduced if the temperature of the air increases above 70° C.

In accordance with another aspect of this disclosure, there is provided a hair dryer comprising:

(a) a primary air flow path extending from a primary inlet port provided on a first side of the hair dryer and extending to a primary outlet port provided on a first outer portion of the hair dryer;

(b) an air moving member provided in the primary air flow path;

(c) the primary inlet port comprises a screen, whereby ingress of hair into the interior of the primary air flow path is inhibited; and, (d) a secondary air flow path extending from a secondary inlet port provided on a second outer portion of the hair dryer to a secondary outlet port provided on the first side of the hair dryer.

In any embodiment, the secondary outlet port may comprise a plurality of secondary air outlets positioned around the primary inlet port.

In any embodiment, the plurality of secondary air outlets may direct air inwardly towards a center of the primary inlet port.

In any embodiment, the hair dryer may further comprise a heating element in the secondary air flow path.

In any embodiment, the heating element may be an energizable heating element.

In any embodiment, the energizable heating element may be manually actuatable.

In any embodiment, the hair dryer may further comprise a sensor and the energizable heating element may be energized upon issuance of a signal from the sensor. Optionally, the sensor may be a moisture sensor.

In any embodiment, the air moving member may comprise a motor and fan assembly having a motor, a first fan blade assembly and a second fan blade assembly, the first fan blade assembly is positioned in the primary air flow path and the second fan blade assembly is positioned in the secondary air flow path.

In any embodiment, the first fan blade assembly may produce a first level of suction and the second fan blade assembly may produce a second level of suction wherein the second level of suction may be less than the first level of suction.

In any embodiment, the first fan blade assembly may produce a first volume of air flow and the second fan blade assembly may produce a second volume of air flow, wherein the second volume of air flow may be higher than the first volume of air flow.

In any embodiment, the first fan blade assembly may be a high suction fan blade assembly and the second fan blade assembly may be a high volume fan blade assembly.

In any embodiment, the hair dryer may further comprise an infrared heating element that, in operation, may direct infrared heat to a location forward of the primary inlet port.

In any embodiment, the hair dryer may further comprise a heating element in the secondary air flow path. Optionally, the heating element may be an energizable heating element.

In any embodiment, the primary outlet port may direct air away from the first end of the hair dryer.

In any embodiment, the secondary outlet port may be provided on a second side of the hair dryer and the second side may be axially opposed to the first side.

In any embodiment, the hair dryer may further comprise a heating element in the secondary air flow path and a temperature sensor operably connected to the heating element to maintain a temperature of air exiting the secondary outlet port less than 70° C.

In any embodiment, the hair dryer may further comprise a heating element in the secondary air flow path and a temperature sensor operably connected to the heating element to maintain a temperature of hair being dried to less than 70° C.

In any embodiment, the hair dryer may further comprise a heating element in the secondary air flow path and a temperature sensor operably connected to the heating element to maintain a temperature of hair being dried to less than 60° C.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
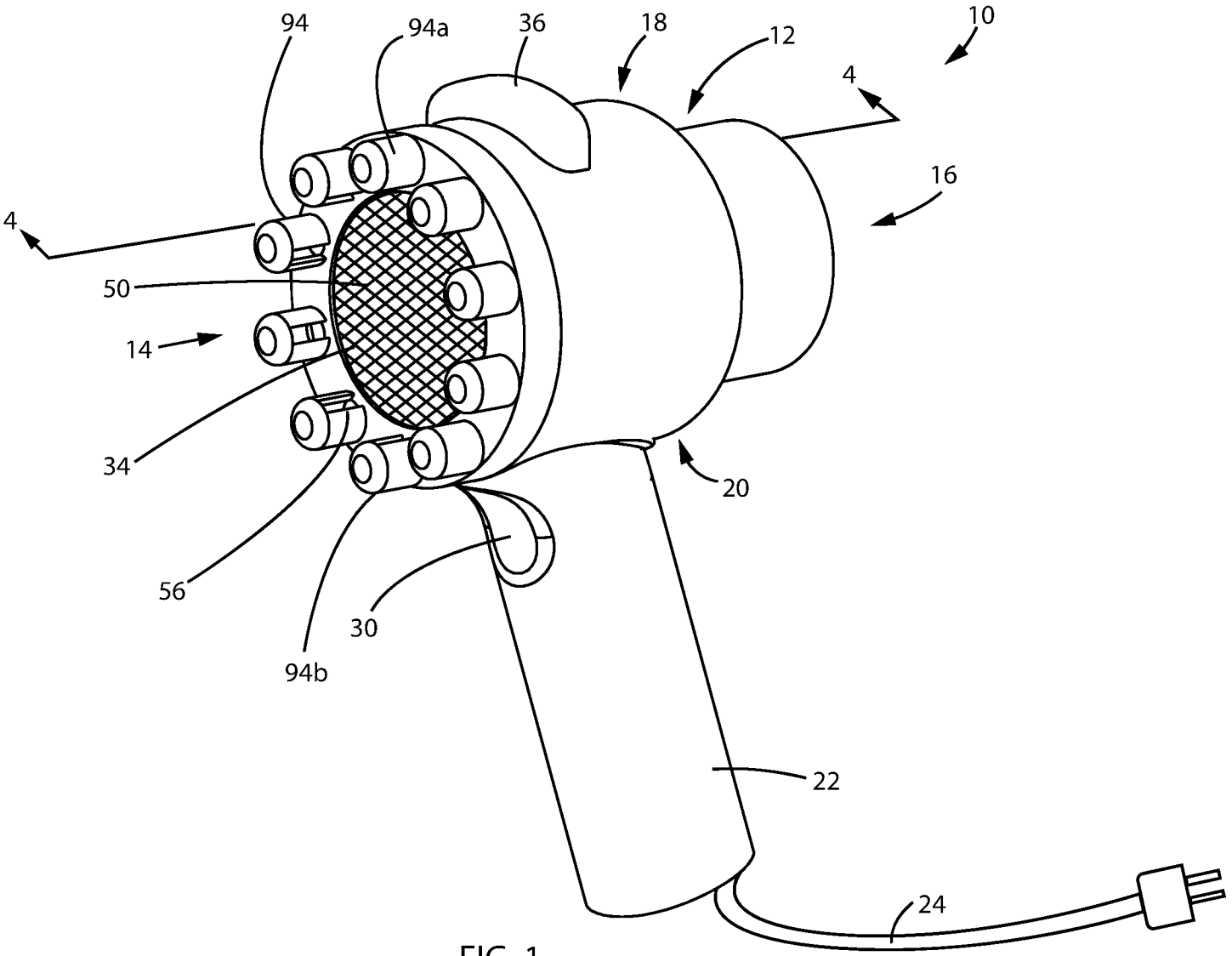
FIG. 1 is a side front perspective view of a hair dryer according to a first embodiment.
Figure 2:
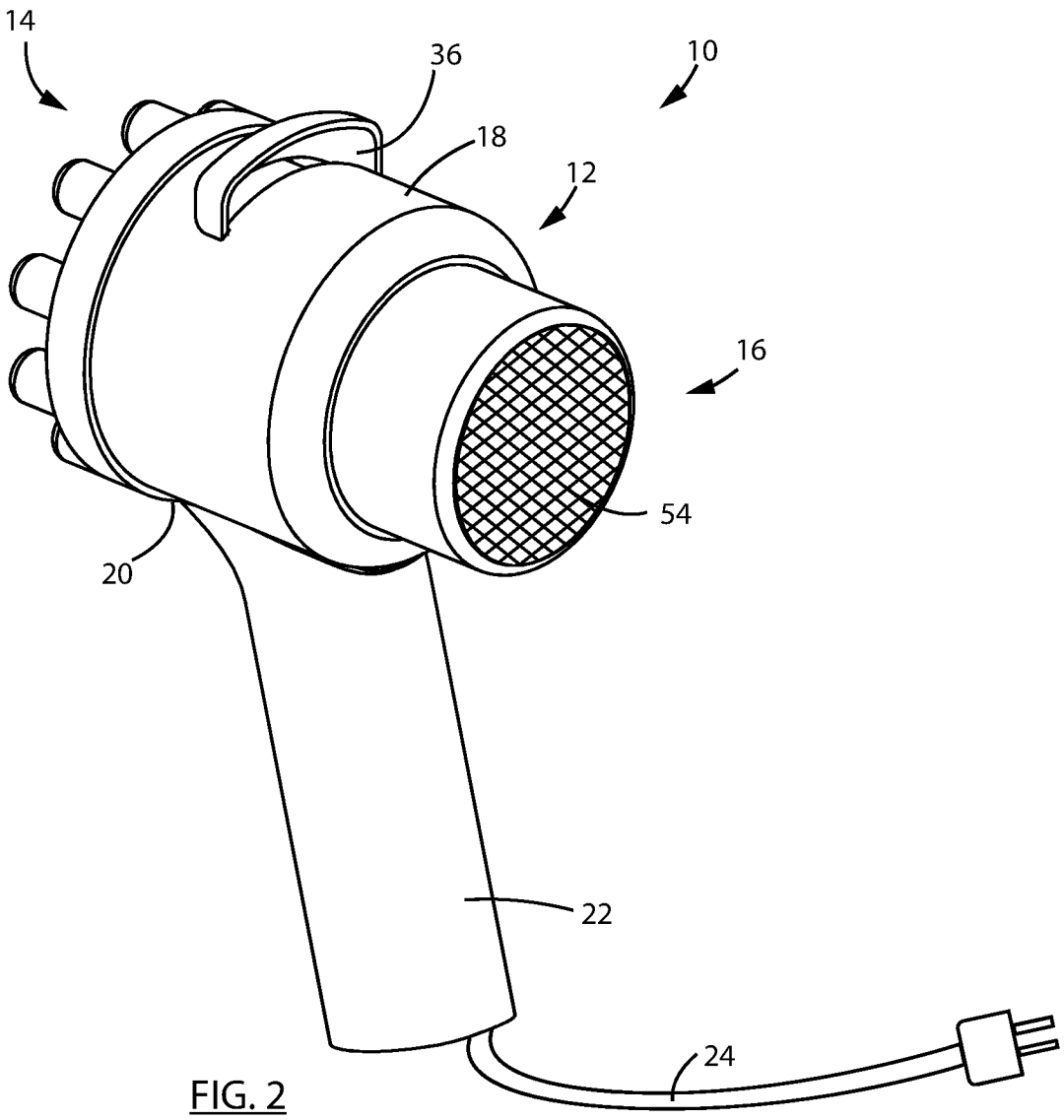
FIG. 2 is a rear perspective view of the hair dryer of FIG. 1.
Figure 3:
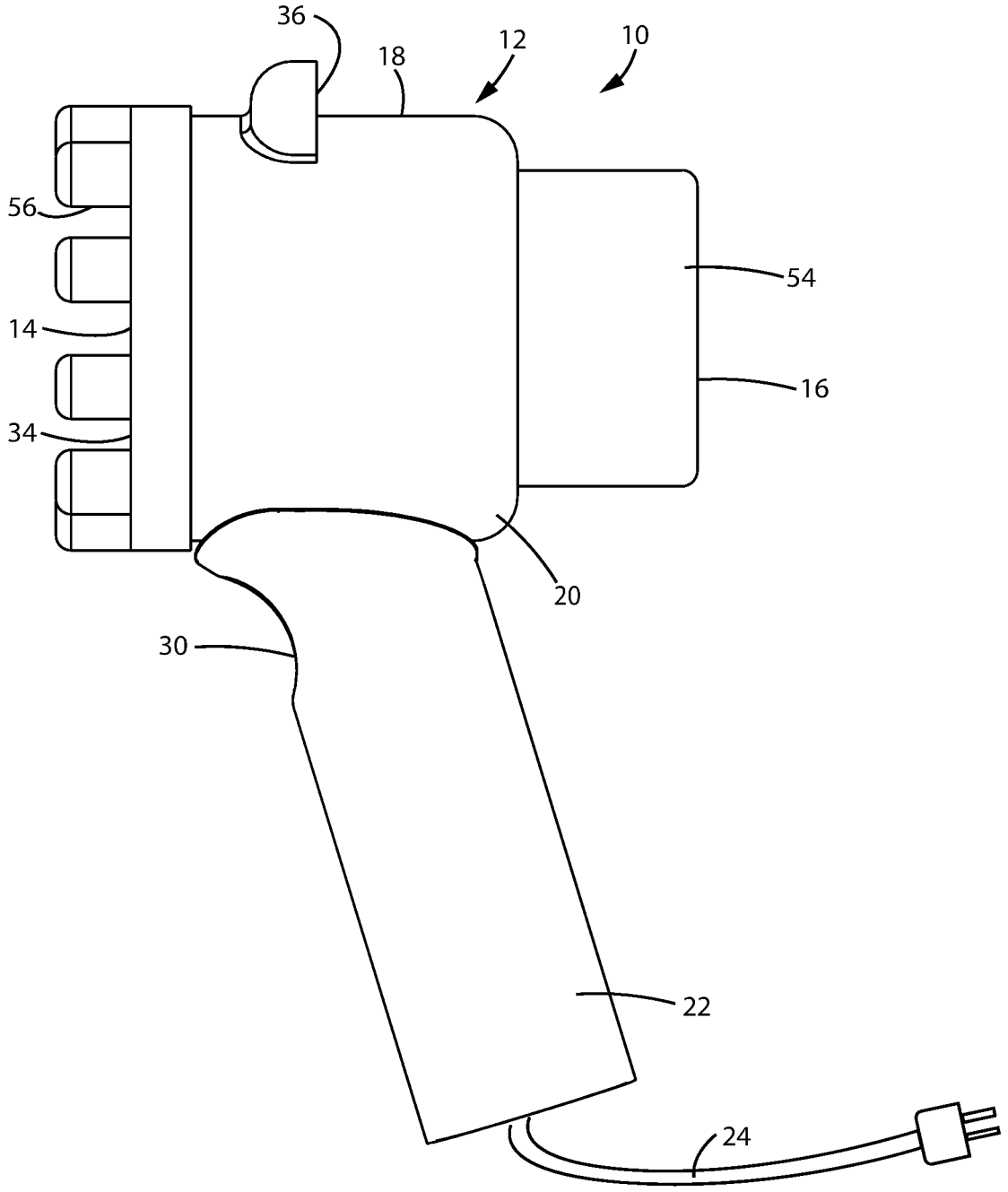
FIG. 3 is a side plan view of the hair dryer of FIG. 1.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

General Description of a Hair Dryer

As exemplified in FIGS. 1-4 a hair dryer 10 has a main body 12 having a front end 14, a rear end 16, a top end 18, a bottom end 20 and a handle 22. It will be appreciated that main body 12 may be of any shape.

As exemplified, handle 22 is provided on the bottom end of the hair dryer 10 and is in the form of a pistol grip handle.

It will be appreciated that handle 22 may be of any shape and may be provided at any location of the hair dryer 10.

Hair dryer 10 may be powered using household current. Accordingly, a power cord 24 may be provided. Optionally, power cord 24 may be removably mounted to the hair dryer. Power cord 24 may be provided at any location on the hair dryer 10. As exemplified, power cord 24 is provided at the lower end of handle 22, but it may be placed elsewhere.

Alternately, or in addition, hair dryer 10 may be powered by one or more on board energy storage members. The on board portable energy storage members may be one or more primary batteries, rechargeable batteries, super-capacitors, fuel cells or hydrogen combustion engines or turbines and may be provided at any location in the hair dryer 10. As exemplified in FIGS. 4 and 8, handle 22 houses a plurality of batteries 26. As exemplified in FIG. 9, the batteries may be provided in a battery pack 28, which may be removably mounted (e.g., slideably mounted) in the hair dryer, such as in handle 22. As exemplified in FIGS. 5-8, hair dryer 10 may be powered only by one or more on board energy storage members.

The on board energy storage members may be rechargeable in situ (e.g., they may be recharged when power cord 24 is plugged into a household power outlet) or they may be removed from hair dryer 10 for recharging. It will be appreciated that hair dryer 10 may be provided with two or more battery packs 28. Accordingly, a first battery pack 28 may be inserted, e.g., into handle 22 and used to operate hair dryer 10 while a second battery pack 28 is held in reserve (e.g., it may be recharged in a recharging station). When the first battery pack is discharged or is replaced, the first battery pack 28 may be removed (and optionally placed in a charging station to be recharged) and the second battery pack 28 may be installed in hair dryer 10. Accordingly, a self-powered hair dryer may be continuously operated by using different battery packs 28.

Power button 30 is provided to actuate hair dryer 10. Power button 30 may be provided at any location. As exemplified in FIG. 1, power button 30 is provided on handle 22. Power button 30 may be of any type. As exemplified, power button 30 is a member that is pressed inwardly into handle 22 to actuate hair dryer. Power button 30 may be a rocker switch or a slidable switch. Power button 30 may have only on and off positions. Alternately, it may have different positions for different fan speeds (e.g., low and high or low, medium and high).

Hair dryer 10 is provided with an air moving member. The air moving member may be any member that may be provided in a hair dryer to move air through the hair dryer. As exemplified herein the air moving member comprises a motor and fan assembly 38. As exemplified in FIG. 4, motor and fan assembly 38 comprises a motor 40, a first fan blade 42 (which is driven by a first axle 46) and a second fan blade 44 (which is driven by an axle 48). Alternately, as exemplified in FIG. 8, motor and fan assembly 38 comprises a motor 40 and a first fan blade 42 (which is driven by a first axle 46).

As exemplified in FIGS. 1-8, hair dryer 10 has a primary air flow path 32 that extends from an inlet port 34 to an outlet port 36 and a secondary air flow path 52 that extends from an inlet port 54 to an outlet port 56. The primary air flow path 32 may be used in a first mode of operation to dry hair and the secondary air flow path 52 may be used in a subsequent second mode of operation to dry the hair using heat. Various configurations for the primary and secondary air flow paths 32, 52 may be used. The primary and secondary air flow paths 32, 52 may be isolated from each other as in the embodiment of FIGS. 1-4. Alternately the secondary air flow path 52 may be an extension of the primary air flow path 32 if some or all of the air in the primary air flow path is redirected to the front of the hair dryer 10 (see for example the embodiment of FIGS. 5-8).

Primary Air Flow Path

Figure 4:
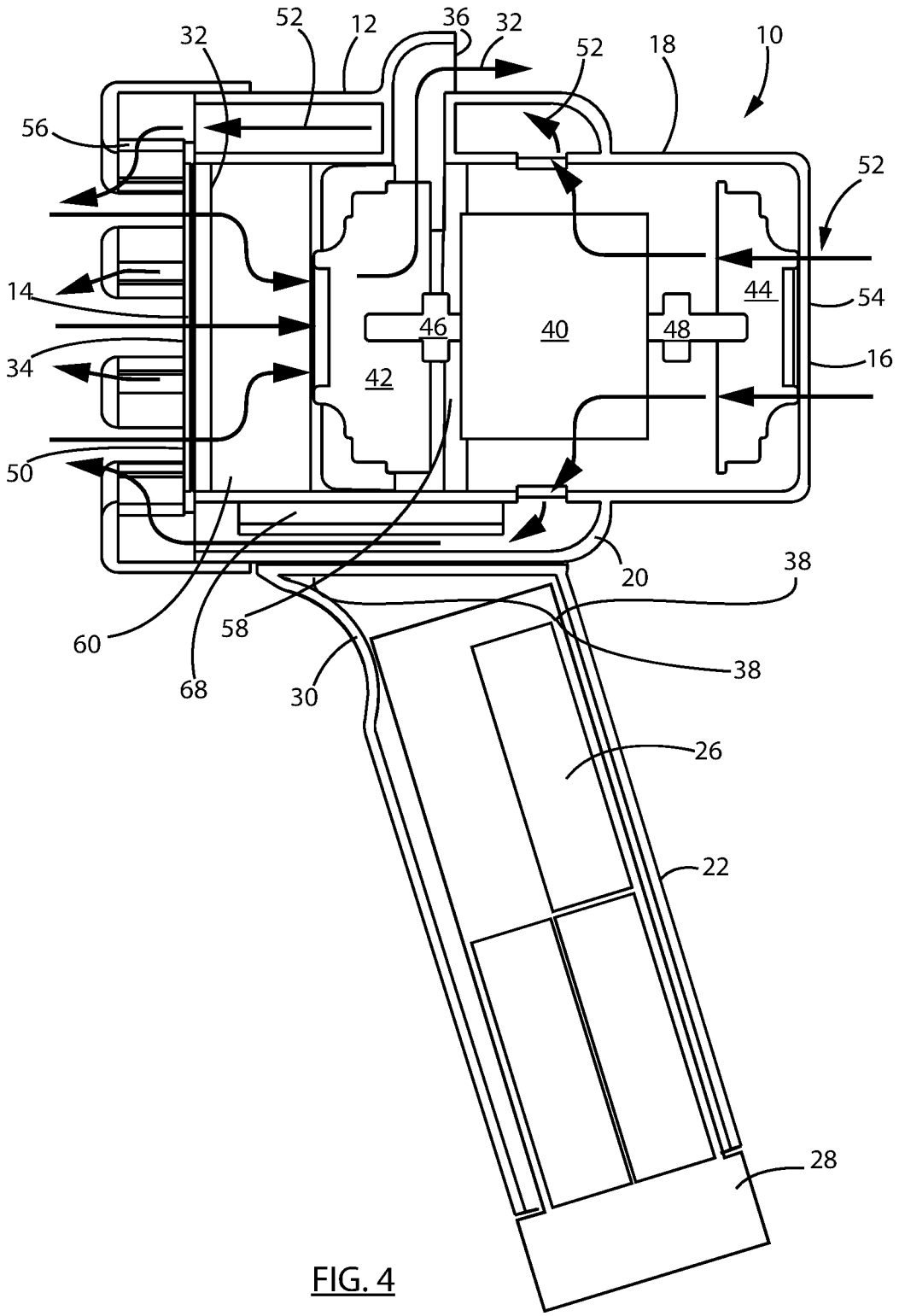
FIG. 4 is a cross-sectional view along the line 4-4 in FIG. 1.
Figure 5:
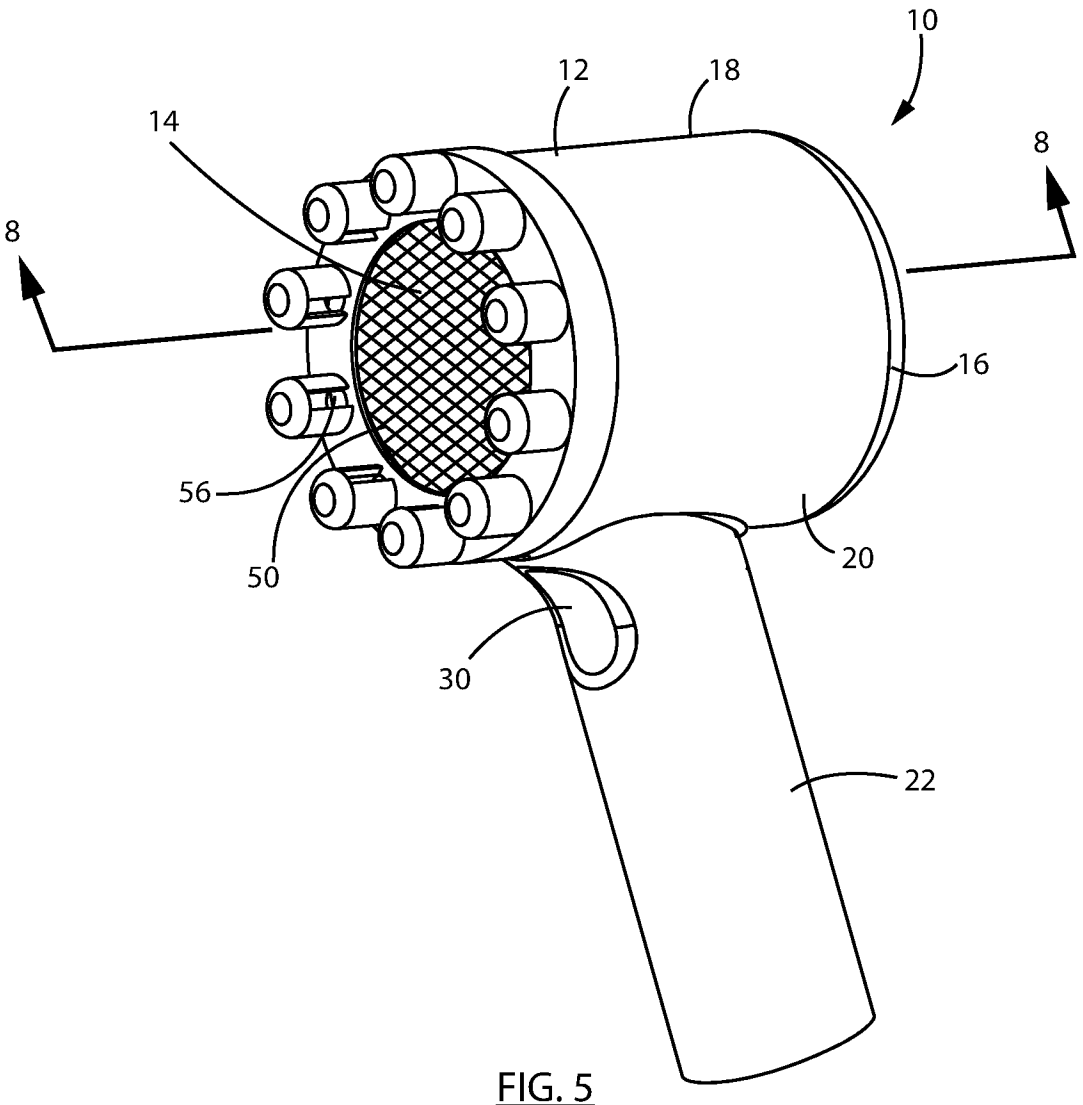
FIG. 5 is a side front perspective view of a hair dryer according to another embodiment.
Figure 6:
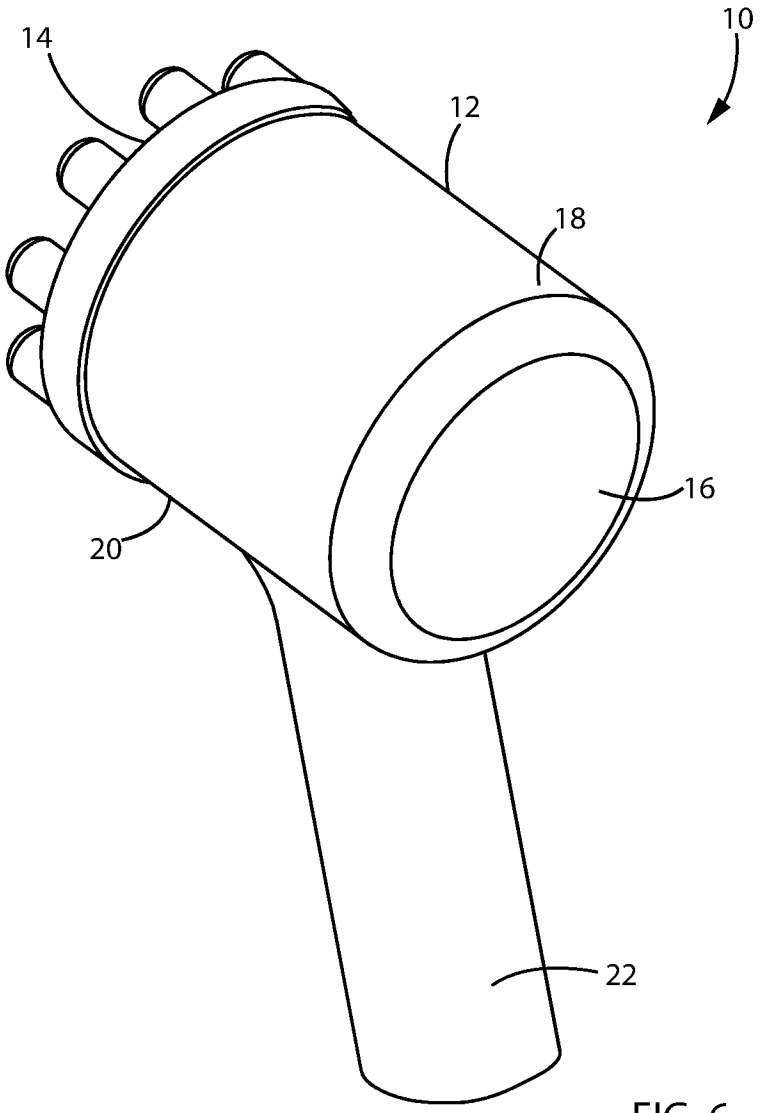
FIG. 6 is a rear perspective view of the hair dryer of FIG. 5.
Figure 7:
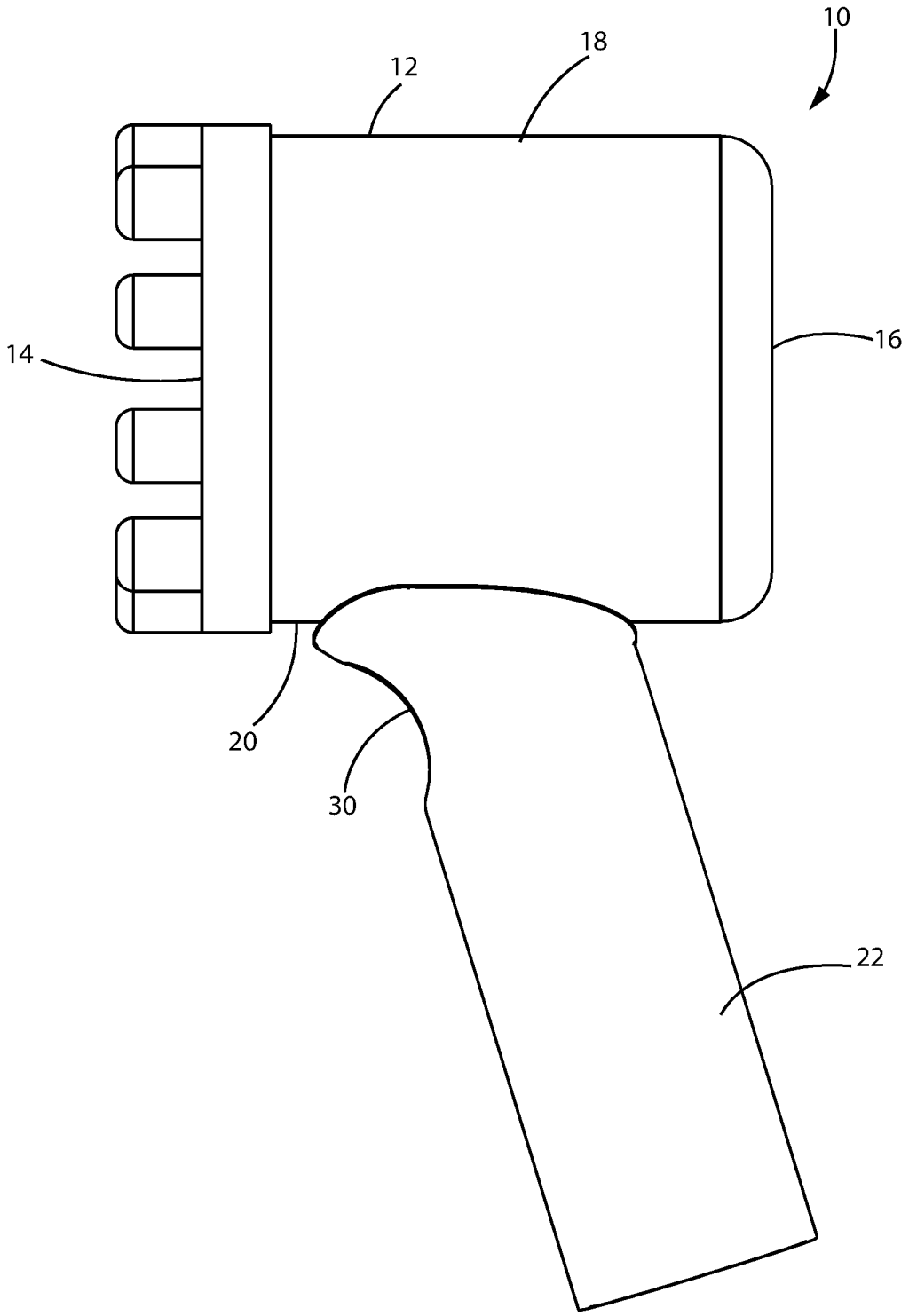
FIG. 7 is a side plan view of the hair dryer of FIG. 5.
Figure 9:
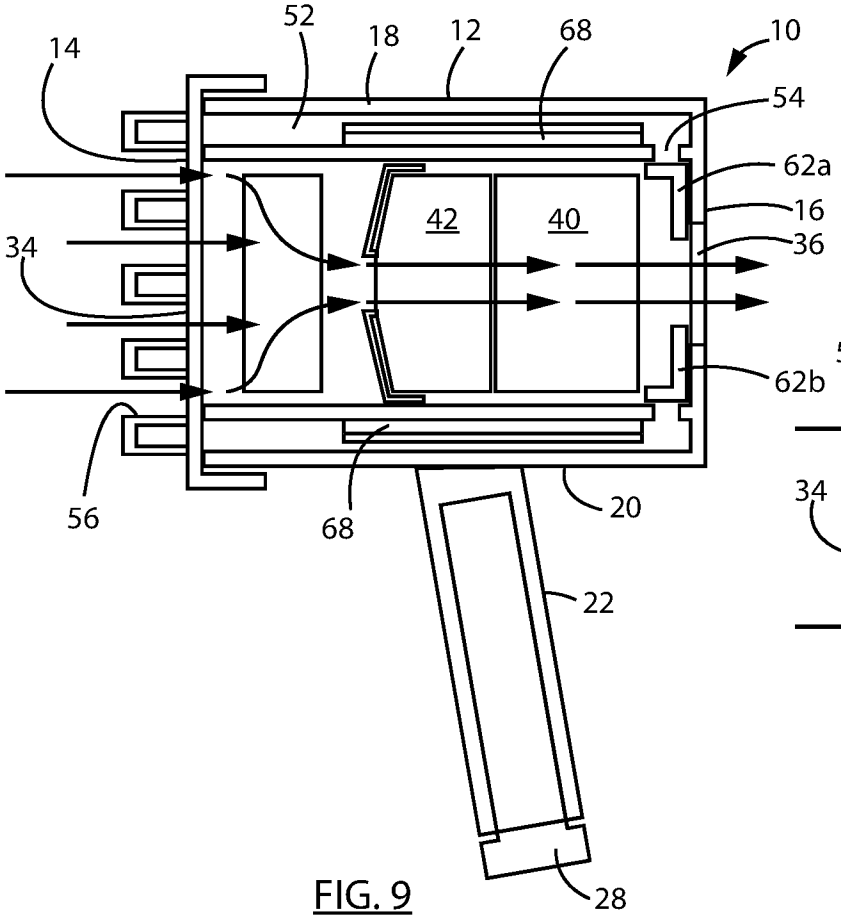
FIG. 9 is a cross-sectional view of a further alternate embodiment of the hair dryer configured in a first mode of operation.

Air may flow in a single direction through primary air flow path 32 e.g., from the front end 14 towards the rear end 16 as exemplified in FIG. 4 or to rear end 16 as exemplified in FIG. 9. In FIG. 4, reference numerals 32 point to arrows that show the air flowing through the primary air flow path. Accordingly, reference numeral 32 is used to designate the primary air flow path. Primary air flow path 32 may be of any design that draws air into the hair dryer and subsequently exhausts the air.

It will be appreciated that outlet port 36 may be provided at any location and may direct air in any direction. The air travelling through the primary air flow path may be exhausted from hair dryer 10 in a direction such that the exhausted air is not directed back towards the hair being dried. Accordingly, outlet port 36 may direct air rearwardly and/or upwardly (see for example FIGS. 4 and 13).

Alternately, some or all of the air travelling through primary air flow path 32 may be directed back towards the hair being dried. In such a case, air from the primary air flow path 32 that is redirected at the hair being dried may form some or all of the air in a secondary air flow path 52 (see for example FIG. 8).

An air moving member is provided to draw air into primary air flow path 32. It will be appreciated that each of primary air flow path and secondary air flow path may have its own motor and fan assembly provided therein. Alternately, a single motor and fan assembly may be used to move air through each of the primary and secondary air flow paths.

As exemplified in FIG. 4, primary air flow path 32 is isolated from secondary air flow path 52 and a single motor and fan assembly 38 is utilized. Air containing water that passes over a motor may damage the motor over time. Accordingly, when the air entering primary air flow path has water in it (from drying hair), optionally some or all of the water may be removed as discussed subsequently. Alternately, or in addition, the air moving member may be configured to inhibit or prevent water passing over the motor.

Figure 15:
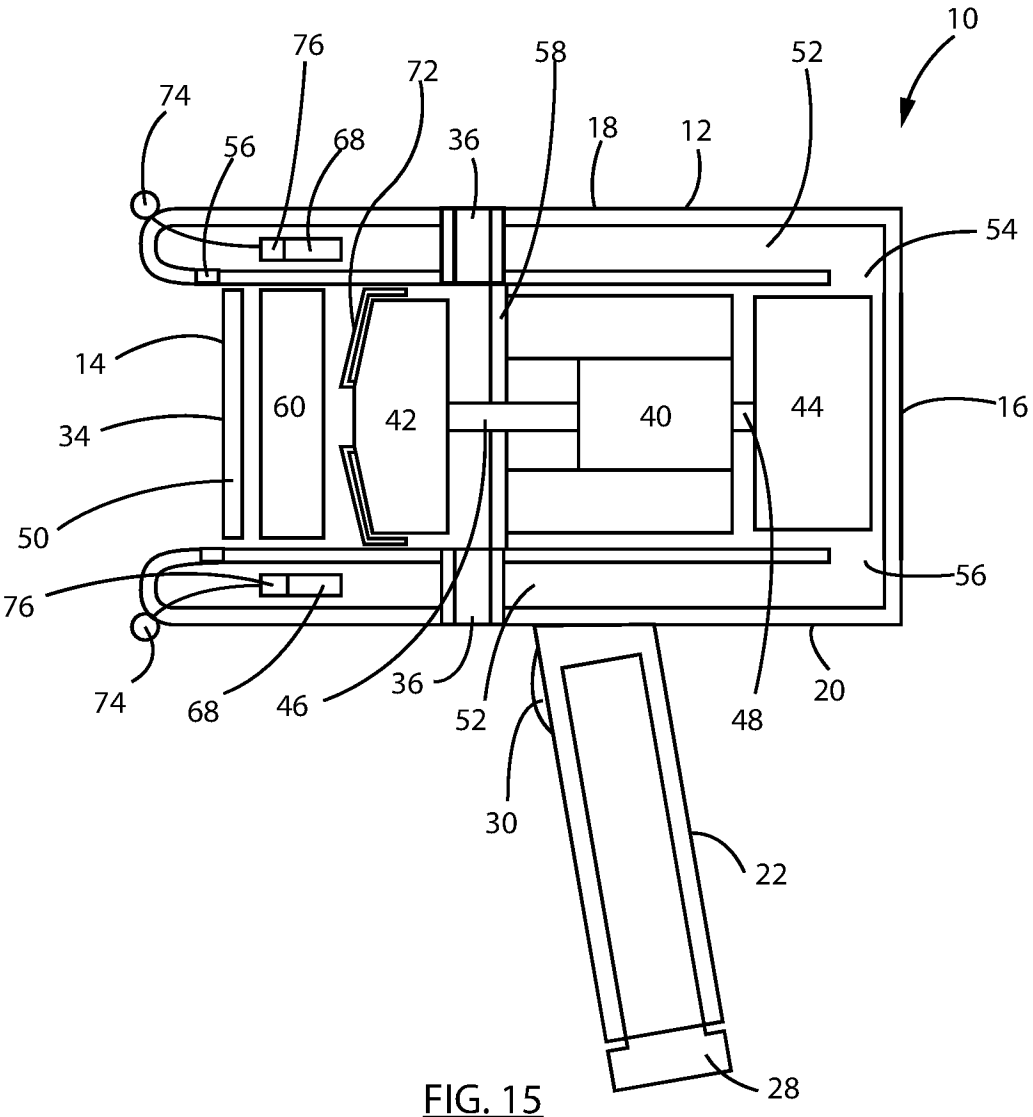
FIG. 15 is a cross-sectional view of a further alternate embodiment of the hair dryer having a motor and fan blade assembly that comprises two opposed fan blades.

FIGS. 4 and 15 exemplify an embodiment wherein the air moving member is configured to inhibit or prevent water passing over the motor 40. As exemplified in FIGS. 4 and 15, first fan blade 42 may be a by-pass fan. Such a fan blade is configured to draw air through primary air flow path 32 without the air passing over motor 40. Accordingly, motor 40 may be positioned exterior to primary air flow path 32, e.g., motor 40 may be positioned in a motor housing that is sealed or essentially sealed from primary air flow path 32. As exemplified in FIG. 4. Bulkhead wall 58 is positioned in front of motor 40 and axle 46 extends from motor 40 through bulkhead wall 58 to first fan blade 42. A bearing may be provided in the opening of bulkhead wall 58 through which axle 46 extends. Accordingly, in operation, motor 40 causes fan blade 42 to spin and draw air in through inlet port 34, to and past fan blade 42 and out through outlet port 36. As exemplified in FIGS. 1-4, a single outlet port 36 may be provided, such as on the top end of the main body 12. Alternately, as exemplified in FIG. 15, two or more outlet ports 36 may be provided.

Figure 8:
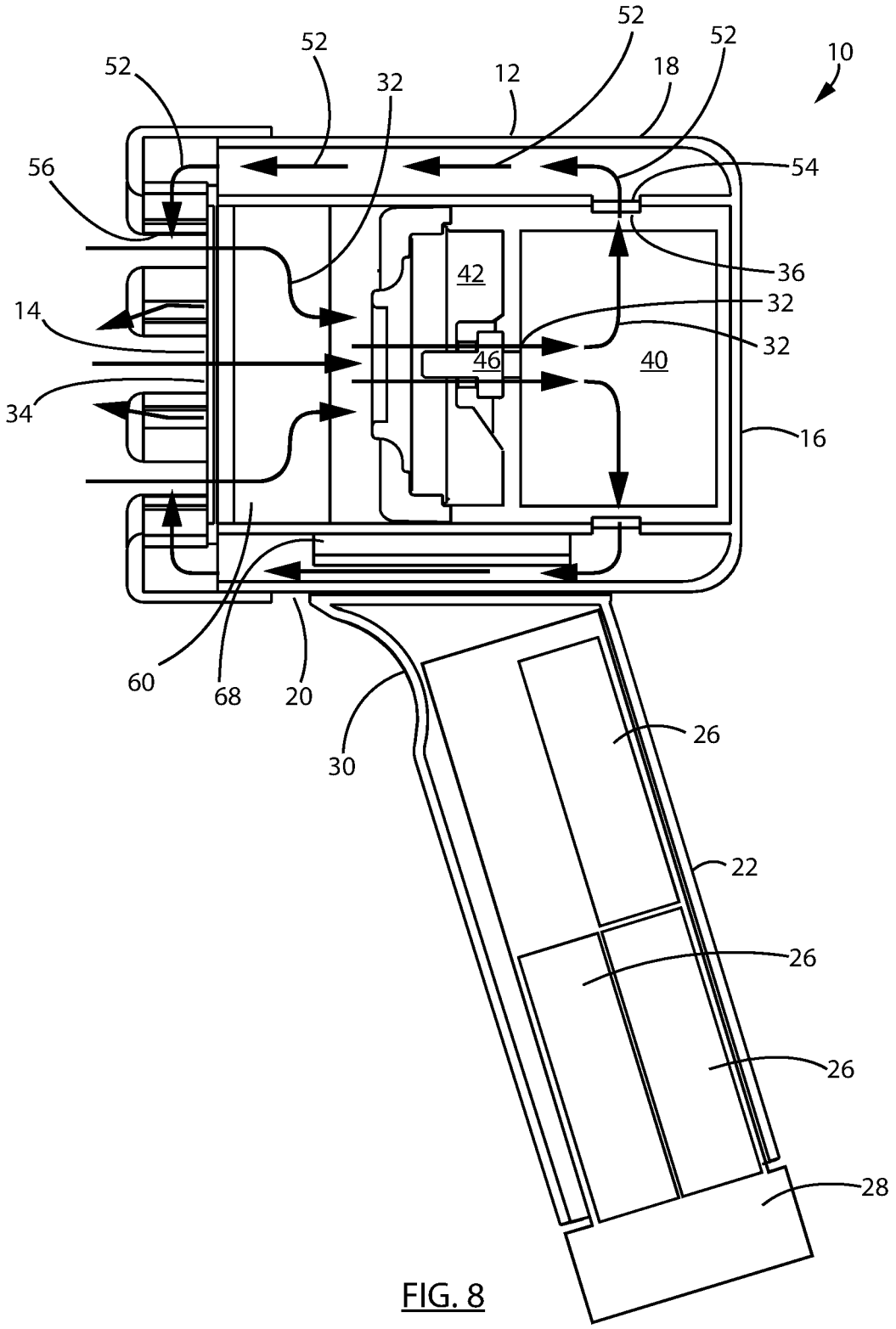
FIG. 8 is a cross-sectional view along the line 8-8 in FIG. 5.

FIG. 8 exemplifies an embodiment wherein some or all of the water is removed to reduce or prevent water being present in air that passes over the motor 40. As exemplified in FIG. 8, a water collection member 60, which is discussed subsequently, is provided in primary air flow path 32 upstream of motor 40.

Secondary Air Flow Path

Air may flow in a single direction through secondary air flow path 52 e.g., from the rear end 16 or a rearward portion of hair dryer 10 to the front end 14. As mentioned previously, some or all of the air travelling through primary air flow path 32 may be directed back towards the hair being dried through secondary air flow path 52. Such an embodiment is exemplified in FIG. 8.

In FIG. 8, reference numerals 52 point to arrows that show the air flowing through the secondary air flow path. Accordingly, reference numeral 52 is used to designate the secondary air flow path. Secondary air flow path 52 may be of any design that exhausts air towards hair that is being dried. The air travelling through the secondary air flow path may be exhausted from hair dryer 10 in a direction such that the exhausted air is directed towards the hair being dried.

It will be appreciated that inlet port 54 may be provided at any location. Accordingly, for example, inlet port 54 may be a port on the exterior of hair dryer 10 or which draws air from the ambient into hair dryer 10 and into secondary air flow path 52. It will be appreciated that if some or all of the air travelling through primary air flow path 32 is directed back towards the hair being dried through secondary air flow path 52, then outlet port 36 of primary air flow path 32 may be inlet port 54 of secondary air flow path 52. Accordingly, as exemplified in FIG. 8, air enters hair dryer 10 through inlet port 34 provided at front end 14 and travels rearwardly through water collection member 60 to motor and fan assembly 38 and then through outlet port 36 (which doubles as inlet port 54) and forwardly through secondary air flow path 52 to outlet ports 56 provided on front end 14.

Redirecting Member

In accordance with this aspect, primary and secondary air flow paths 32, 52 may be connectable in air flow communication with each other. This aspect may be used by itself or in combination with one or more of the other aspects set out herein.

An advantage of this aspect is that air may travel in a single direction through hair dryer 10 (e.g., from front end 14 to or toward the rear end 16) and accordingly, the primary air flow path may have a lower back pressure. In contrast, in the embodiment of FIG. 8, air is redirected through hair dryer 10 when hair dryer 10 is in use and therefore the back pressure through hair dryer 10 during the first mode of operation (drying hair by drawing air through the hair) may be higher.

Figure 10:
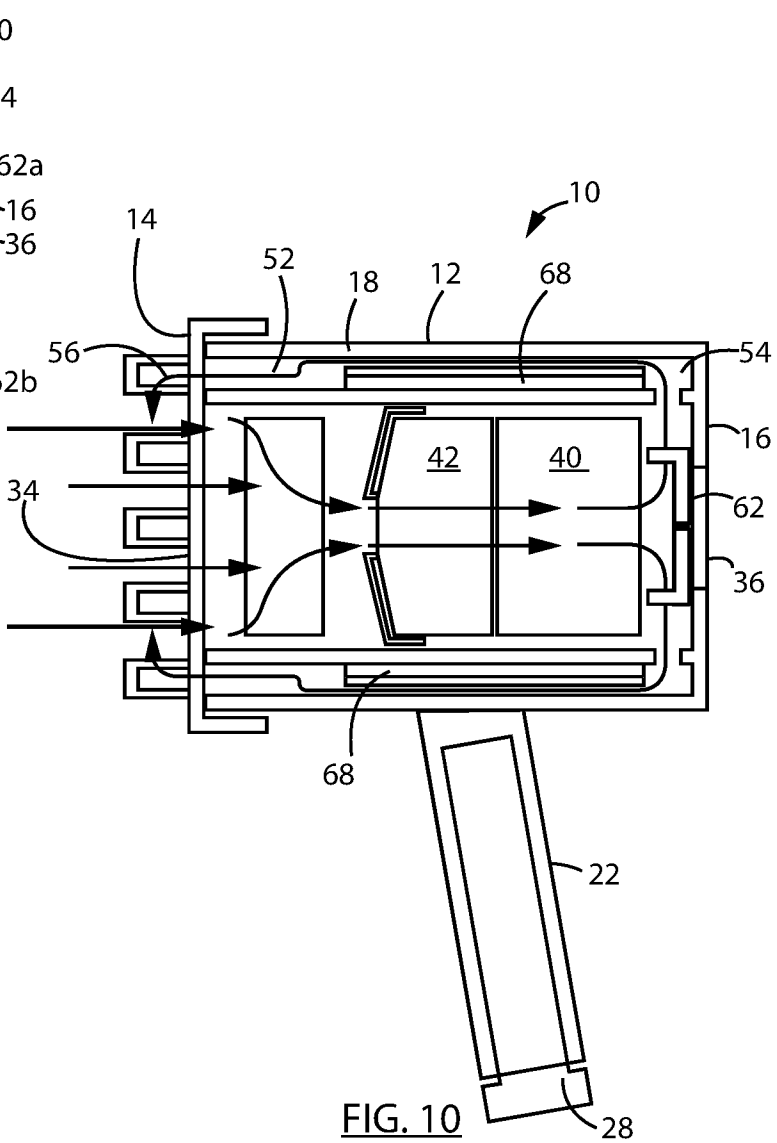
FIG. 10 is a cross-sectional view of the further alternate embodiment of the hair dryer of FIG. 9 configured in a second mode of operation.

As exemplified in FIGS. 9 and 10, a redirecting member 62 is provided. In the configuration of FIG. 9, the redirecting member is open and air may exit primary air flow path 32 via outlet port 36. In the configuration of FIG. 10, redirecting member has been moved to close outlet port 36. Accordingly, air travelling through primary air flow path 32 is directed through inlet port 54 into secondary air flow path 52.

Optionally, it will be appreciated that redirecting member 62 may concurrently open the exit of primary air flow path 32 and close the entrance to secondary airflow path 52. As exemplified in FIGS. 9 and 10, redirecting member 62 is operable between a first open position in which an exit from primary air flow path 32 is open and the entrance (inlet port 54) to secondary air flow path is closed and a second closed position in which an exit from primary air flow path 32 is closed and the entrance (inlet port 54) to secondary air flow path is opened.

Redirecting member 62 may be any member that may be repositionable and/or reconfigurable to close off primary air flow path 32 to cause some or all of the air to enter secondary air flow path 52. For example, redirecting member 62 may be an iris, a valve, sliding shutters having upper and lower portions 62*a*, 62*b* (see FIG. 9) or the like.

Dual Sided Hair Dryer

In accordance with this aspect, one side of a hair dryer 10 (e.g., the front side) uses suction to draw moisture from wet hair and the a second (e.g., axially opposed side) blows hair, optionally heated air, to further dry the wet hair. This aspect may be used by itself or in combination with one or more of the other aspects set out herein.

An advantage of this aspect is that the air flow path through the hair dryer may be simplified. One hair has been dried to a particular degree of dryness using suction, a user may turn the hair dryer around and then use the other side (e.g., the rear side) to blow dry the wet hair.

Figure 14:
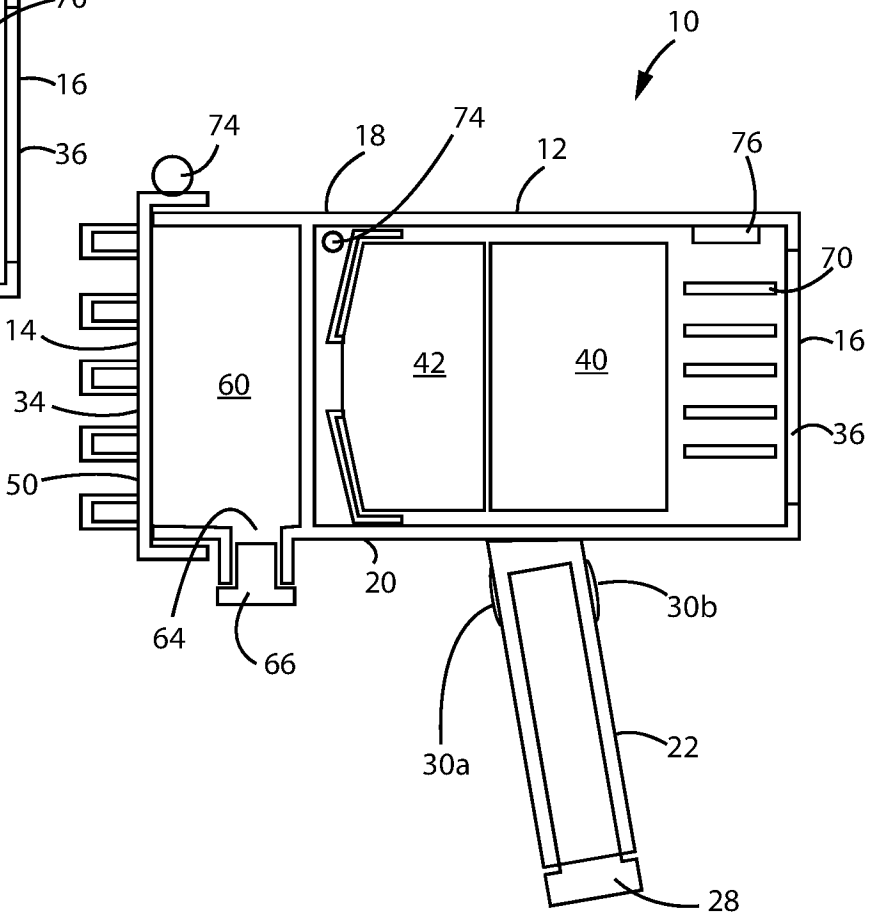
FIG. 14 is a cross-sectional view of a further alternate embodiment of the hair dryer having an openable water storage container.
Figure 13:
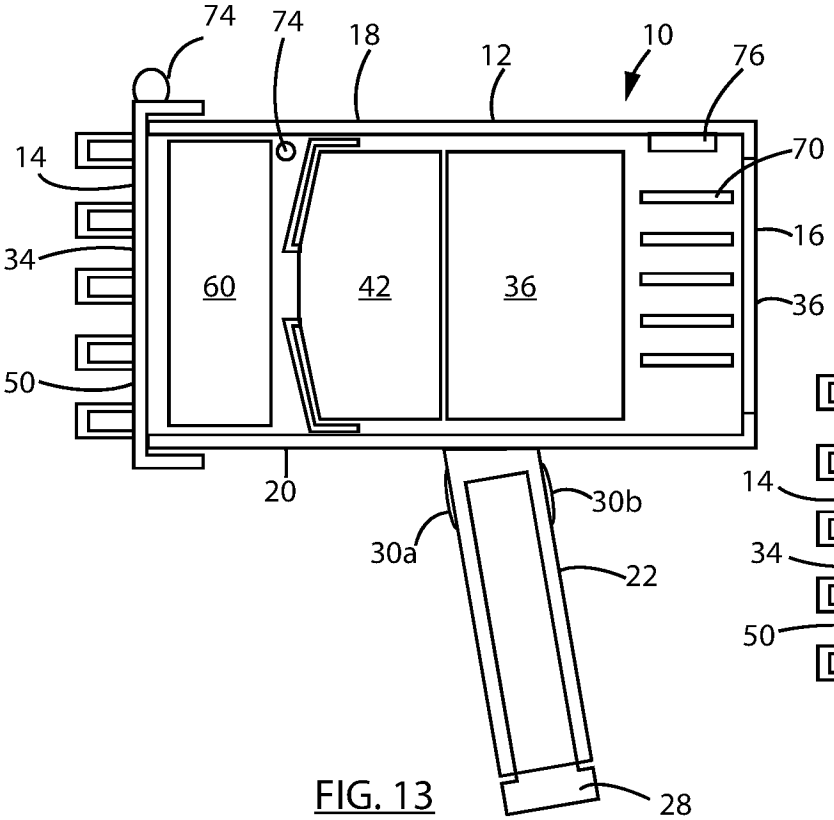
FIG. 13 is a cross-sectional view of a further alternate embodiment of the hair dryer having a removable porous water absorbent member.

For example, FIGS. 13 and 14 are similar to FIG. 8 except that no secondary air flow path 52 is provided. Accordingly, primary air flow path 32 is the only air flow path in hair dryer. As exemplified air enters through inlet port 34 provided at front end 14 of main body 12 and exists through outlet port 36 provided at rear end 16 of main body 12. A heating element 70 may be provided upstream of outlet port 56. Heating element 70 may be separately actuatable or it may be actuated when motor 40 is energized.

It will be appreciated that in embodiments which use a dual sided hair dryer that a separate power button may be provided for each mode of operation. For example, as exemplified in FIG. 13, when the first side of hair dryer is in operation (e.g., in the first drying mode of operation) then power button 30*a*, which faces forwardly, may actuate hair dryer 10. Similarly, when the second side of hair dryer is in operation (e.g., in the second drying mode of operation) then power button 30*b*, which faces rearwardly, may actuate hair dryer 10.

Alternate Fan Blade Design

In accordance with this aspect, if an air moving member has two fan blades, then a first fan blade may be configured to provide relatively more suction than a second fan blade and the second fan blade may be configured to provide relatively more air flow than the first fan blade. For example, the first fan blade may be configured such that the fan blade is located proximate the cowling of a motor and fan blade assembly air inlet. The second fan blade may be configured such that the fan blade is located spaced from a cowling around the fan blade. Increasing the spacing between a cowling and the fan blade may increase the air flow produced by the fan blade and reduce the suction produced by the fan blade. Decreasing the spacing between a cowling and the fan blade may increase the suction produced by the fan blade and reduce the air flow produced by the fan blade. This aspect may be used by itself or in combination with one or more of the other aspects set out herein.

An advantage of this aspect is that, when the hair dryer is operating in the first mode, relatively more suction may be provided and when the hair dryer is being used in the second mode, relatively more air flow may be provided.

For example, in the embodiment of FIG. 15, each fan blade is in a different air flow path. First fan blade 42 is positioned in primary air flow path 32 close to cowling 72 and second fan blade 44 is positioned in secondary air flow path 52 spaced from motor 40 and rear end 16. Accordingly, first fan blade 42 will produce more suction than fan blade 44. The additional suction assists in drawing moisture from hair into inlet port 34. Conversely, fan blade 44 will produce more air flow than fan blade 42. The higher air flow is beneficial when hair dryer is used to blow dry hair.

Variable Suction Fan Blade

In accordance with this aspect, a motor and fan blade assembly may be reconfigurable to produce enhanced suction or enhanced air flow. This aspect may be used by itself or in combination with one or more of the other aspects set out herein. In particular, this aspect may be used in conjunction with, or in lieu of, using different fan blade configurations as discussed previously.

In accordance with this aspect, the fan blade is reconfigurable by adjusting the gap between an upstream face of a fan blade and a fan blade cowling. Increasing the gap would tend to increase the air flow produced by the fan blade whereas decreasing the gap would tend to increase the suction produced by the fan blade.

Figure 12:
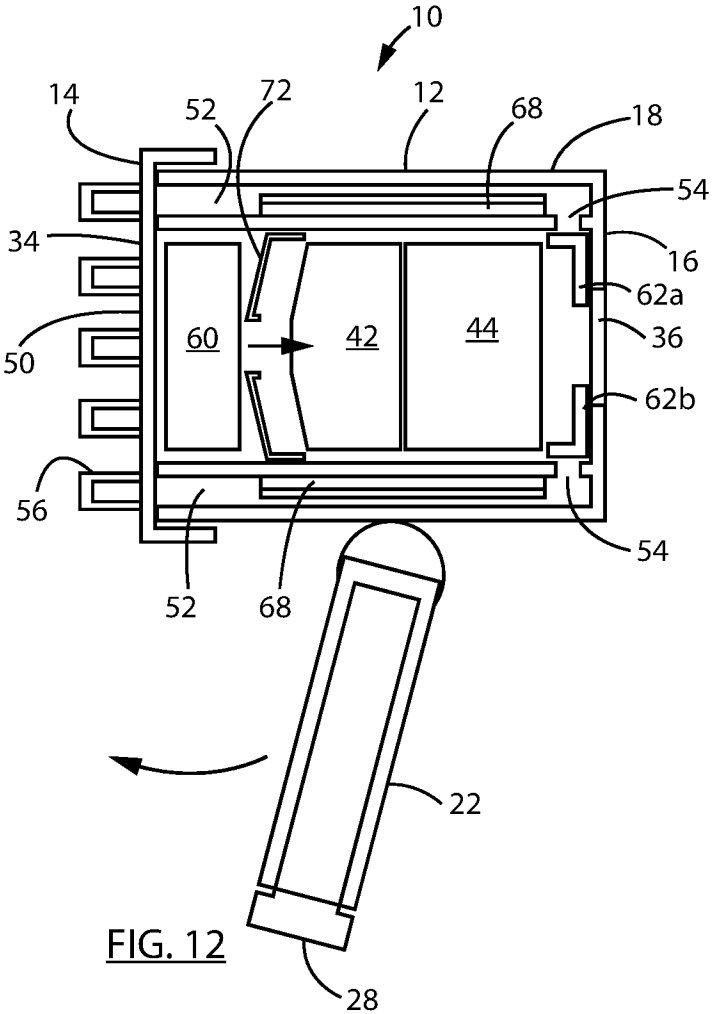
FIG. 12 is a cross-sectional view of the further alternate embodiment of the hair dryer of FIG. 11 configured in a high air flow mode of operation.
Figure 11:
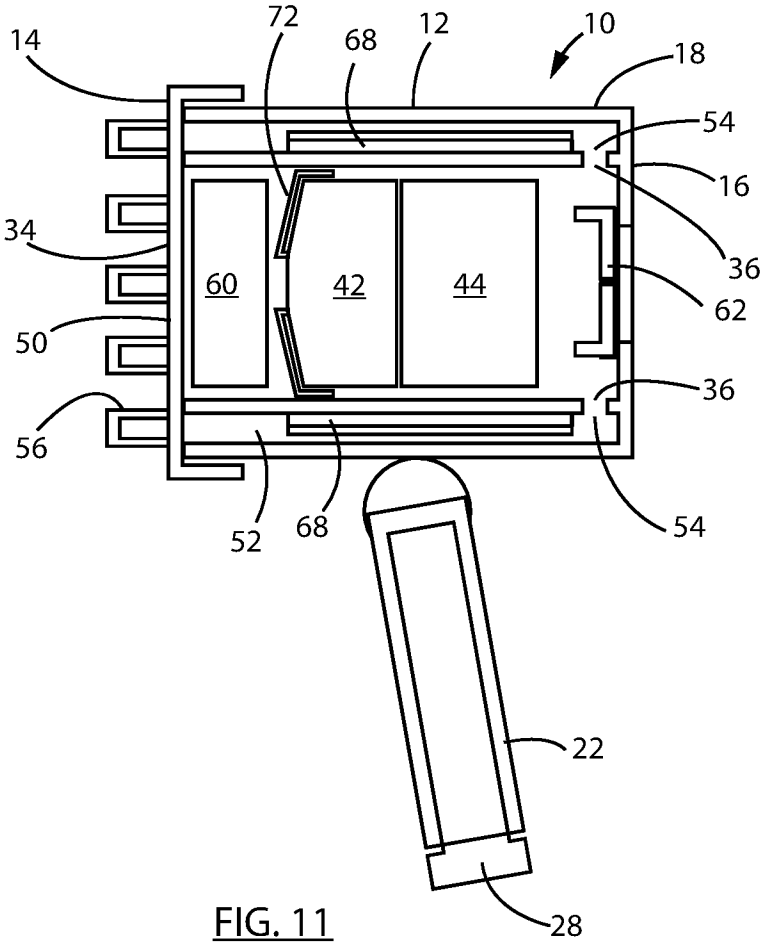
FIG. 11 is a cross-sectional view of a further alternate embodiment of the hair dryer configured in a high suction mode of operation.

The gap may be adjustable my manually moving fan blade 42 with respect to cowling 72. Alternately, the fan blade may be moved by an electronically actuated member (e.g., a solenoid). As exemplified in FIGS. 11 and 12, handle 22 is moveably (e.g., pivotally) mounted to main body 12. Pivoting the handle adjusts the gap between the upstream face of fan blade 42 and fan blade cowling 72. Accordingly, a mechanical linkage extending between handle 22 and cowling 72 and/or fan blade 42 may be provided. As the handle is pivoted, e.g., forwardly from the high suction mode position of FIG. 11 to the high air flow mode position of FIG. 12, the gap between the upstream face of fan blade 42 and fan blade cowling 72 is increased thereby adjusting motor and fan blade assembly 38 to produce higher air flow and lower suction. Conversely, as the handle 22 is pivoted, e.g., rearwardly from the high air flow mode of FIG. 12 to the high suction mode position of FIG. 11, the gap between the upstream face of fan blade 42 and fan blade cowling 72 is decreased thereby adjusting motor and fan blade assembly 38 to produce higher suction and lower air flow.

Accordingly, when a user desires to change drying mode from the first mode to the second mode, the user may rotate the handle forwardly to produce higher air flow for blow drying.

Water Collection Member

In accordance with this aspect, some, a substantial portion (e.g., 20-70 wt. %, 30-60 wt. % or 30-50 wt. %) or substantially all of water entering inlet port 34 is removed by one or more water collecting members 60. This aspect may be used by itself or in combination with one or more of the other aspects set out herein.

An advantage of this aspect is that water may be removed from an air stream passing over motor 40 to reduce or prevent water damaging motor 40. A further advantage is that, if some or all of the air is heated to use in drying hair, water has been removed from the air that is to be heated thereby reducing the power requirement to heat the air.

Accordingly, if some or all of the exhausted air is directed back towards the hair being dried and/or is passes over motor 40, then the air may be treated to remove water therefrom prior to the air being directed back towards the hair being dried. Alternately or in addition, the air may be heated prior to the air being directed back towards the hair being dried. It will be appreciated that even if some or all of the exhausted air is not directed back towards the hair being dried, the air may still be treated to remove water therefrom prior to the air being exhausted from hair dryer 10.

Water collecting member 60 may collect water by trapping water as air passes through the water collecting member (e.g., water collecting member may be an open cell foam), by changing the air flow pattern and sequestering water in a container (e.g., by using a momentum separator or cyclone) or the like. The air flow pattern may be adjusted by the velocity of the air travelling through the container being reduced (e.g., the cross-sectional flow area of the container is greater than the cross-sectional flow area of inlet port 34). The container may accordingly be a momentum separator or may be in flow communication with a momentum separator. Alternately, or in addition, the container may be a collection chamber for a cyclone.

If water collection member 60 is open cell foam (see for example FIG. 13), then water absorbed by the open cell foam may be removed by compressing the open cell foam, withdrawing the open cell foam for drying or replacement with a drier open cell foam (e.g., through an openable port provided on main body 12 and/or removing the front end 14 of the main body to expose the foam), or enabling air to flow through the open cell foam to evaporate water retained therein. Such air flow may occur during the drying of hair and/or subsequently when the hair is dried and, e.g., the hair dryer is placed in a stand or the like.

If the water collection member is a container in which water is sequestered (see for example FIG. 14), then the container may be emptied by removing the container or removing a plug 66 so as to open a drainage port 64 when the container is on board the hair dryer or has been removed from the hair dryer.

It will be appreciated that a water collection member 60 may be provided regardless of whether air in primary air flow path 32 is redirected to secondary air flow path 52 and/or if a by-pass fan s used.

Drying Hair Using Suction

In accordance with this aspect, hair dryer 10 may be operable in a first mode wherein water is removed from hair by using sub-atmospheric pressure (suction) alone or in combination with the application of heat. The heat may be provided at all times that suction is applied to the hair or only part of the time (e.g., suction may be provided for a first period of time and, subsequently, heat may be provided while suction is applied). This aspect may be used by itself or in combination with one or more of the other aspects set out herein.

An advantage of this aspect is that less power is required to remove water using sub-atmospheric pressure than by using heat. Further the use of less heat or a lower temperature heat will reduce the damage to hair that occurs during the use of a conventional hair dryer.

In accordance with this aspect, hair dryer 10 is provided with a primary air flow path extending from an inlet port 34 to an outlet port 36.

If this aspect is to be used by itself, and optionally in and embodiment using any combination of aspects, hair being dried is inhibited and, optionally prevented, from entering into primary air flow path 32. Accordingly, inlet port 34 may comprise a screen 50. Screen 50 may be any porous member such as a stamped or molded screen, fine woven mesh, an open cell foam such as open cell polyurethane or any combination thereof. The openings of screen 50 may be any size that inhibits or prevents hair entering primary air flow path 32. Accordingly, in a first mode of operation, motor and fan assembly 38 is actuated and draws air into inlet port 34 thereby creating sub-atmospheric pressure in front of inlet port 34. When hair is placed in the proximity of inlet port 34, the hair is drawn against screen 50 and air is drawn through the hair into primary air flow path 32. This action draws (sucks) moisture from the hair and into primary air flow path 32.

Once the air with entrained water enters primary air flow path 32, the air may be exhausted to the ambient via an outlet port 36 (see for example FIG. 4). In such a case, as discussed previously, first fan blade 42 may be a by-pass fan.

Optionally, as exemplified in FIGS. 13 and 14, a water collection member 60 may be provided downstream and optionally immediately downstream of proximate inlet port 34 (e.g., adjacent screen 50). It will be appreciated that, if a by-pass fan blade is used, then water collection member 60 need not be provided. For example, once the air with entrained water enters primary air flow path 32, it may be directed to secondary air flow path. In such a case, a water collection member 60 is optionally provided.

It will be appreciated that, in any embodiment, screen 50 may be heated. As hair may be drawn against screen 50 during at use (e.g., by suction and/or by jets as discussed subsequently), heating screen 50 may assist is contact drying hair that is drawn along screen 50 during use of hair dryer 10. For example, it may include a heating element or a heating element may be placed proximate thereto so as to heat screen 50. For example, as discussed subsequently, infrared heating element 92 may be used to heat screen 50.

Driving Using Heat After the Application of Suction

In accordance with this aspect, hair dryer 10 may be operable in a second mode wherein water is removed from hair by directing heated air at the hair being dried. The heat may be provided at all times that suction is applied to the hair or only part of the time (e.g., suction may be provided for a first period of time and, subsequently, heat may be provided while suction is applied). This aspect may be used by itself or in combination with one or more of the other aspects set out herein.

An advantage of this aspect is that less power is required to remove water using heat as some water has been removed by using sub-atmospheric pressure. Further the use of less heat or a lower temperature heat will reduce the damage to hair that occurs during the use of a conventional hair dryer.

In accordance with this aspect, heated air may be supplied by air exiting the outlet port 56 of the secondary air flow path 52 (see for example FIGS. 4 and 8) or air exiting the outlet port 36 of the primary air flow path 32 (see for example FIGS. 13, 14 and 16-18).

As exemplified in FIGS. 4 and 8, one or more heating elements 68 may be provided in secondary air flow path. Heating element 98 may be any heating element 68 that can heat an air stream flowing through secondary air flow path 52. The heating element may be powered by an on board power supply e.g., batteries to resistively heat the heating element or a combustible fuel (e.g., hydrogen or propane) to produce combustion that heats the heating element 68. Alternately, if hair dryer 10 is corded, heating element 68 may be a resistively heated member that is powered by household current.

It will be appreciated that the heating element may be internal the secondary air flow path 52, it may be external to the secondary air flow path 52 so as to heat the conduit through which the air flows, it may be internal primary air flow path 32, optionally downstream of the motor 38 or it may be external primary air flow path 52 so as to heat the conduit through which the air flows, optionally downstream of motor 40.

Optionally, if the secondary air flow path is annular or substantially annular (e.g., is extends around part or all of the inlet passage downstream from inlet port 42), then the heating element 68 may be one or more elements extending circumferentially around the inlet passage. The heating elements may be a continuous annular or partially annular member or it may comprise a plurality of circumferentially spaced apart heating elements 68.

Heating element 68 may be separately actuatable or it may be actuated when motor 40 is energized.

Alternately, or in addition, the air may be heated by passing over motor 38 or otherwise cooling motor 40. Accordingly, a separate heating element 68 may not be provided.

Sensor

In accordance with this aspect, hair dryer 10 may be operated to limit the temperature of air used to dry hair. For example, once hair has been partially dried by using suction (the first drying mode) heated air, which may be at a lower temperature than conventional hair dryers, may be used to blow dry the partially dried hair. This aspect may be used by itself or in combination with one or more of the other aspects set out herein.

In accordance with this aspect, the temperature of the heated air may be adjusted to prevent hair being heated to more than 70° C. and, optionally, to prevent hair being heated to more than 60° C. or more than 50° C.

For example, as exemplified in FIG. 15, hair dryer 10 may have a sensor to monitor the temperature of hair being dried. For example, a thermal sensor and/or thermal camera may be provided, e.g., adjacent outlet port 56, to monitor the temperature of hair being dried. As or once the temperature reaches a predetermined or pre-set value, about 50° C., about 60° C. or about 70° C., sensor 74 may send a signal to control system 76 (e.g. a controller) which, e.g., reduces the temperature of the air being used to blow dry hair (e.g., reducing or de-energizing power provided to heating element 68) and/or reduce the flow rate of the heated air being used to blow dry hair.

Alternately, or in addition, hair dryer 10 may have a sensor to monitor the temperature of air being used to blow dry hair. For example, a thermal sensor may be provided, e.g., in secondary air flow path 52, to monitor the temperature of air in secondary air flow path 52. As or once the temperature reaches a predetermined or pre-set value, about 50° C., about 60° C. or about 70° C., a sensor may send a signal to control system e.g. a controller) which, e.g., reduces the temperature of the air being used to blow dry hair (e.g., reducing or de-energizing power provided to heating element 68) and/or reduce the flow rate of the heated air being used to blow dry hair.

Mode Sensor

In accordance with this aspect, hair dryer 10 may automatically energize a heating element when used to blow dry hair (e.g., when hair dryer 10 is used in the second drying mode of operation). This aspect may be used by itself or in combination with one or more of the other aspects set out herein.

An advantage of this aspect is that less power may be used to dry hair as one or more heating elements may only be powered (e.g., resistively heated) when the hair dryer is used for blow drying with heated air. Accordingly, a cordless hair dryer may require a reduced amount of on board power (e.g., fewer batteries).

In accordance with this aspect, a sensor may be provided to detect when hair dryer 10 is not being used in the first drying mode. Such an embodiment may particularly be used in embodiments that comprise a dual sided hair dryer. For example, a distance sensor such as a small Lidar or ultrasonic sensor may optionally be used to determine or detect the distance of, e.g., front end 14 of hair dryer 10 to the hair of the user. When the sensor detects that hair (a person's head) is not within a particular predetermined distance (and optionally the motor 40 is energized by a user, e.g., actuating power button 30), then sensor may send a signal (e.g., by a wire) to a control system (e.g., a controller) to actuate a heating element 70 (see for example FIGS. 13 and 14).

Alternately, or in addition, a pressure sensor may be used. For example, a pressure sensor may be provided in primary air flow path 32 (e.g., upstream of motor and fan blade assembly 38). Once the pressure sensor measures a particular pressure, or an increase in pressure, which is indicative of hair being withdrawn from in front of screen 50, then sensor 74 may send a signal (e.g., by a wire) to a control system (e.g., a controller) to actuate a heating element 70 (see for example FIGS. 13 and 14).

Air Multiplier

In accordance with this aspect, hair dryer 10 may include an air multiplier. This aspect may be used by itself or in combination with one or more of the other aspects set out herein.

An advantage of this aspect is that enhanced air flow, e.g., during the second mode of operation, may be produced.

The air flow multiplier may be any design that induces air to flow along a surface or through a channel, and may employ the Coanda effect and/or may use an air foil.

Figure 16:
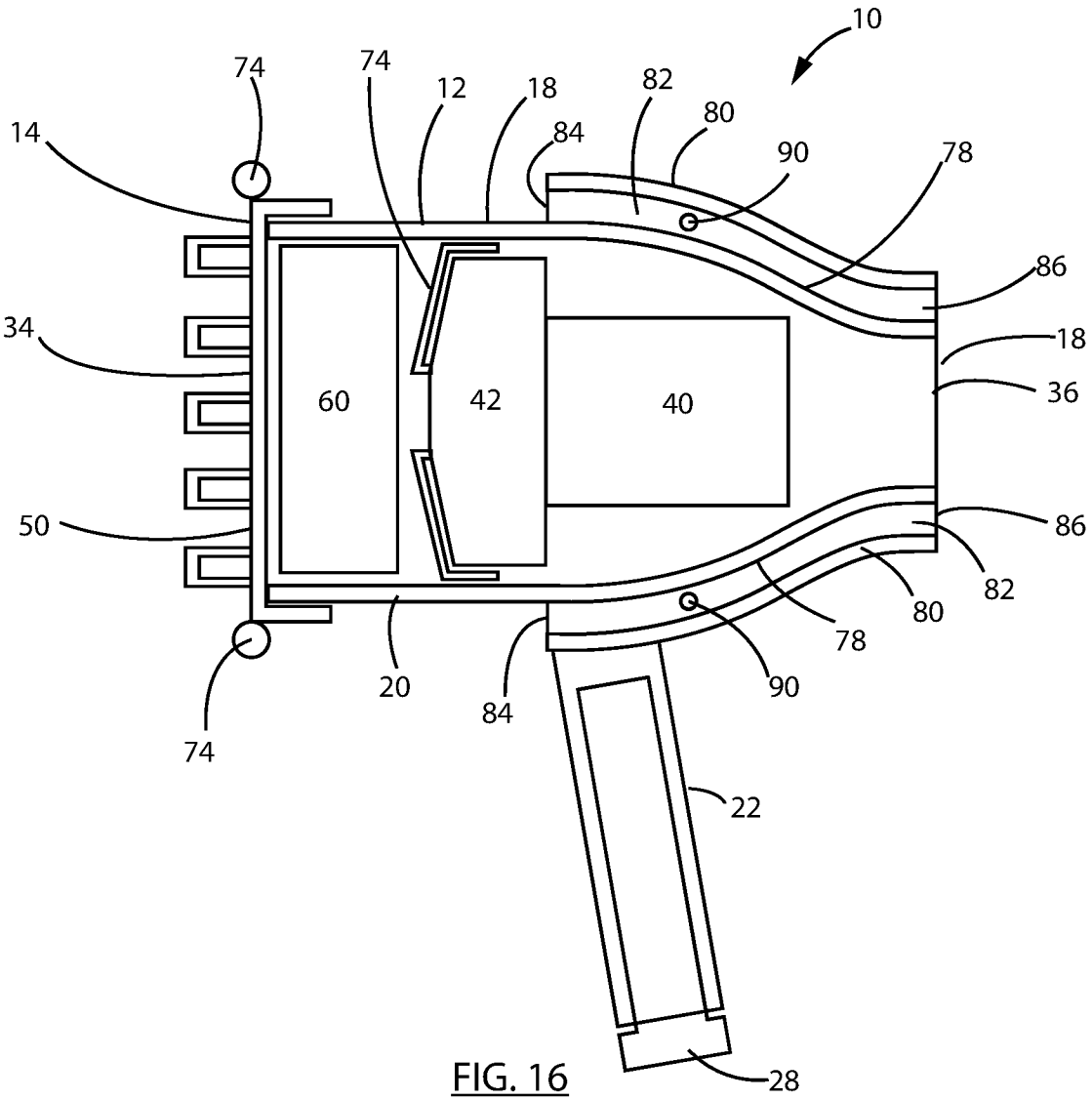
FIG. 16 is a cross-sectional view of a further alternate embodiment of the hair dryer having an exterior air foil at the second, rearward end of the hair dryer.

As exemplified in FIG. 16 the outer surface of rear end 16 of main body 12 is shaped like an air foil. Accordingly, as air exits primary air flow path 52 via outlet port 36, air is induced to flow along outer surface 78. The induced air flow merges with air exiting outlet port 36 so as to increase the volume of air that is available for blow drying.

Optionally, an outer wall 80 may be provided outward of outer surface 78 so as to define a channel 82 through which the induced air flow travels. Channel 82 has an inlet 84 and an outlet 86. As exemplified, outlet 86 is preferably adjacent outlet port 36.

Optionally, outer wall 80 may surround rear end 16 of main body 12 such that channel 82 is annular. It will be appreciated that channel 82 may surround part or all of rear end 16 and may comprise a single continuous annular or semi annular channel or it may comprise a plurality of partially annular channels which, in totality, may surround most or all of rear end 16.

Figure 17:
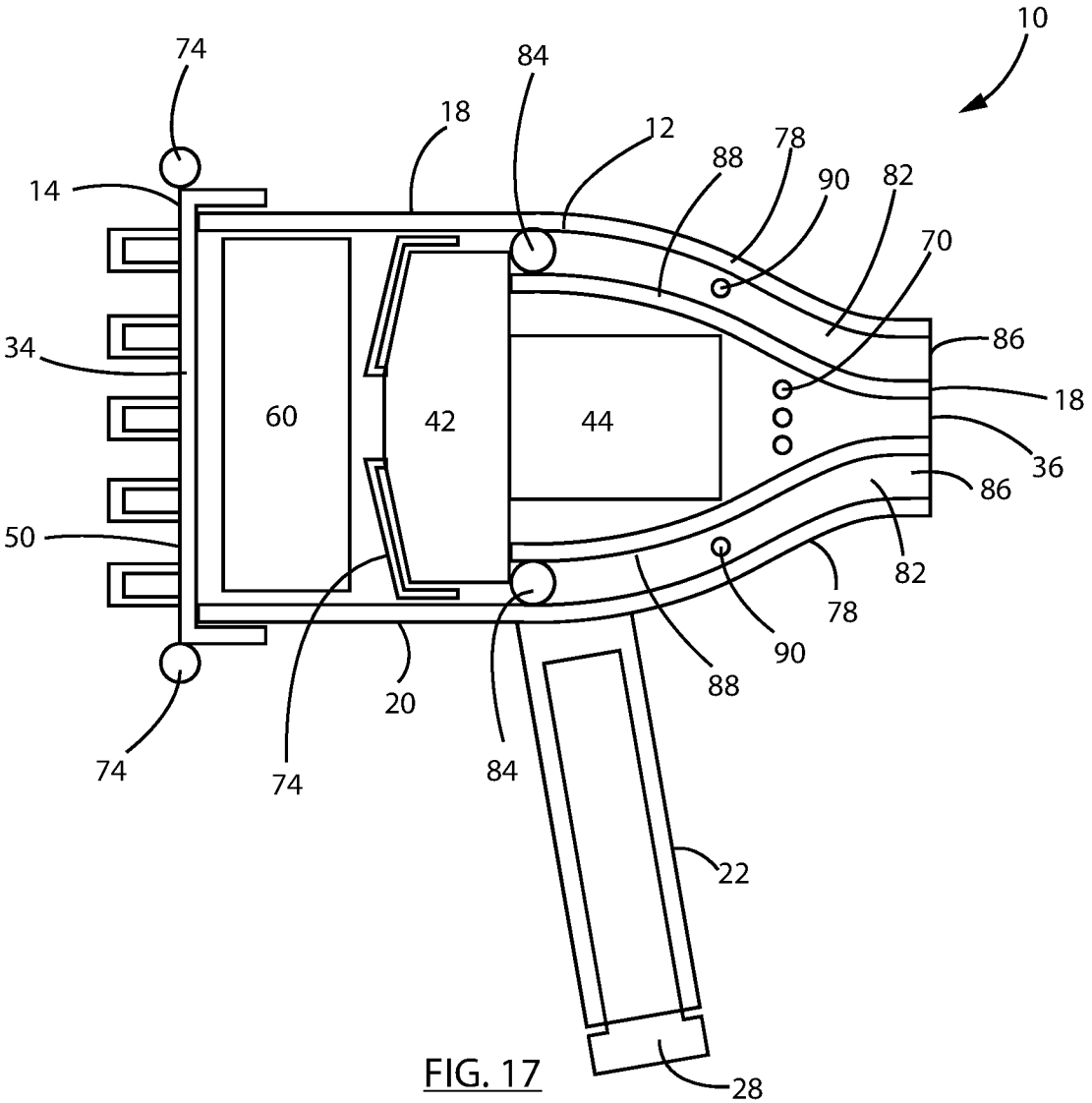
FIG. 17 is a cross-sectional view of a further alternate embodiment of the hair dryer having an interior air foil at the second, rearward end of the hair dryer, and, FIG. 18 is a cross-sectional view of a further alternate embodiment of the hair dryer having an infrared heating element at the first, frontward end of the hair dryer.

Alternately, channel 82 may be provided internal of main body 12 by providing inner wall 88 positioned inward from outer surface 78 of rear end 16 (see for example FIG. 17). In such an embodiment, inlet 84 may be a port on outer surface 78.

It will be appreciated that both an internal channel 82 and an external channel 82 may be provided, each of which may comprise one or more channels extending part or all of the way around primary air flow passage 32.

Optionally, the increased air flow may be heated by a heating element. For example, one or more heating elements 90 may be provided in one or more channels 82. It will be appreciated that heating element 90 may be any heating element discussed herein and may be a resistively heated heating element.

It will be appreciated that a sensor to inhibit or prevent overheating of the hair being dried may be provided on rear end 16.

Infrared Heater

In accordance with this aspect, hair dryer 10 may include an infrared heating element. The infrared heating element may direct IR radiation forwardly and/or rearwardly to assist in drying hair. This aspect may be used by itself or in combination with one or more of the other aspects set out herein.

An advantage of this aspect is that heat produced by the IR radiation may enhance drying during the first and/or second mode of drying.

Figure 18:
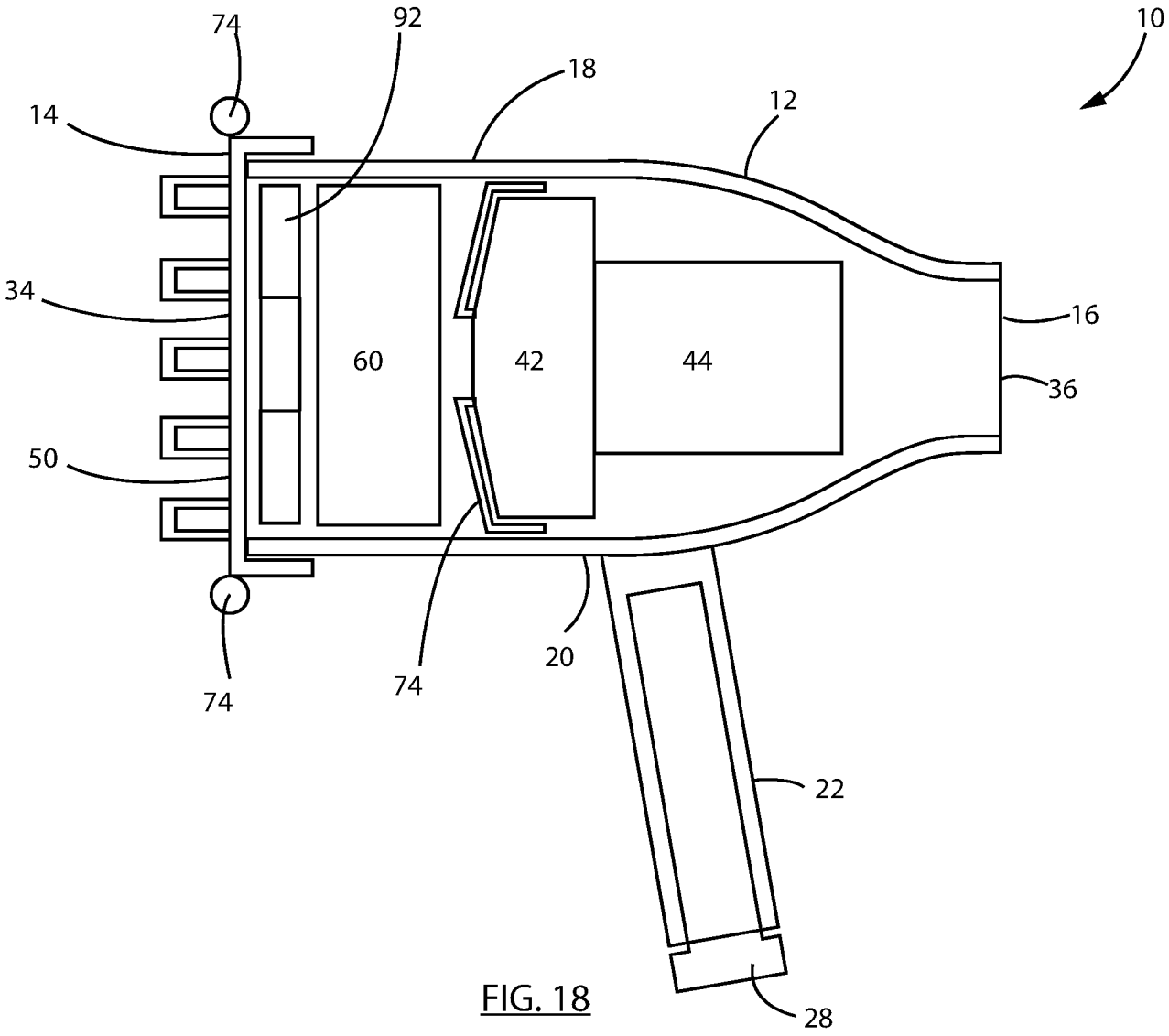

As exemplified in FIG. 18, infrared heating element 92 is provided at front end 14 and, optionally immediately downstream of inlet port 34. Optionally, infrared heating element 92 may abut or positioned adjacent the inner surface of screen 50.

Infrared heating element 92 may be any infrared heating element 92, such as a nickel chrome element. It may comprise a generally annular infrared heating element 92 or a plurality of, e.g., point source infrared heating elements 92. Infrared heating element 92 may be positioned proximate screen 50 and (e.g., forward of water collection member 60 is a water collection member is provided). Infrared heating element 92 may heat screen 50 such as by abutting the inside surface of the screen or being positioned closet to the inner surface of the screen 50. Accordingly, when hair is drawn or blown against screen 50, the hair may be dried by contact heating with screen 50.

In operation, infrared heating element 92 may be automatically actuated when motor 40 is energized, it may be manually actuated by a user using a separate power control or it may be actuated if a sensor 74 detects, e.g., a particular degree of dryness or temperature of hair being dried.

The effectiveness of infrared heating decreases as the distance from the infrared heating element 92 increases. As hair is drawn against screen 50, and as infrared heating element 92 may be positioned proximate but internal of screen 50, then the infrared radiation may have a short distance to travel and, therefore, much or most of the energy input into the infrared heating element 92 may produce heat that is used to dry hair.

Illumination

In accordance with this aspect, hair dryer 10 may include one or more illumination members. The illumination member or members may convey information as to whether, or which, heating elements are actuated and/or may convey information as to which drying mode is in operation. This aspect may be used by itself or in combination with one or more of the other aspects set out herein.

An advantage of this aspect is that one or mole illumination members (e.g., LEDs) may be used to convey information about the operating mode to a person using the hair dryer 10.

For example, a LED that emits a first color light (e.g., blue) may be actuated when a motor 40 is actuated but no heat is being produced. The LED may be deactivated when the hair dryer is off.

If a heating element is actuated, then the color of light that is emitted may be adjusted or a second color light (e.g., red) may be concurrently emitted. For example, if a heating element 68 is energized to heat air flowing towards the hair being dried in the first mode, then a second color of light may be emitted. Accordingly, blue and red light may be emitted or only red light may be emitted.

Alternately, if an infrared heating element or other heating element to heat screen 50 is provided, then when the heating element is actuated, the color of light that is emitted may be adjusted or a second color light (e.g., red) may be concurrently emitted. For example, if a heating element 92 is energized, then a second color of light may be emitted. Accordingly, blue and red light may be emitted or only red light may be emitted.

If a heating element 68 and a heating element 92 are each provided, then, for example, when the heating element 92 is actuated, a third color light (e.g., orange) may be concurrently emitted. For example, if a heating element 92 is energized, then blue and orange light may be emitted or only orange light may be emitted. For example, if a heating element 68 and a heating element 92 are each energized, then blue, red and orange light may be emitted or only, e.g., red and orange light may be emitted.

In embodiments which use a dual sided hair dryer 10, a light may be emitted (an LED actuated) to indicate the side of the hair dryer that is in use. For example, when a dual sided hair dryer is used in a first drying mode of operation, a light may be emitted, e.g., when power button 30 is actuated, illuminating a forward portion of the hair dryer 10, such as front end 14. Similarly, when a dual sided hair dryer is used in a second drying mode of operation, a light may be emitted, e.g., by actuating an alternate power button, illuminating a rearward portion of the hair dryer 10, such as rear end 16.

Jets

In accordance with this aspect, hair dryer 10 may have a plurality (two or more) of outlet ports that create jets of air, optionally heated air. The jest may be provided during the first and/or second mode of operation. This aspect may be used by itself or in combination with one or more of the other aspects set out herein.

An advantage of this design is that air having a high velocity may be directed to or through the hair being dried. This air may also be directed towards the inlet of their dryer 10.

Optionally, the jet outlets may extend forwardly from an inlet of hair dryer 10. Accordingly, as exemplified in FIG. 1, outlets 56 may be provided on fingers 94. Fingers 94 extend outwardly from inlet 34 of hair dryer 10 and may penetrate the hair of a person that is being dried, similar to the tines of a comb or the bristles of a brush.

As exemplified in FIG. 1, the air outlet 56 comprises a plurality of outlets each of which may produce a jet of air. As shown therein, the outlet 56 comprises a narrow slot. Forming a narrow slot will produce an increase in the rate of air flow. The high rate of flow may be used in conjunction with suction or instead of suction to dry or assist in drying hair.

For example, in one embodiment, one or more air jets may be directed from outlet 56 towards inlet 34 (e.g., towards the suction source). The air jets may be directed at an angle towards inlet 34 or directly towards inlet 34.

Alternately, or in addition, one or more air jets may be directed towards one or more opposed air jets. As exemplified in FIG. 1, outlets 56 are arranged in an annular band around inlet 34. Accordingly, outlets 56 face inwardly towards opposed outlets 56. For example, outlet 56 on finger 94*a* faces directly towards outlet 56 on opposed finger 94*b*. It will be appreciated that, in an alternate embodiment, two or more pairs of opposed jets may be provided. For example, two opposed rows of outlets may be provided wherein at least some, and optionally each, outlet in one row faces an outlet of the other row so as to form a plurality of pairs of opposed outlets. Each outlet of a pair of opposed outlets produces a jet that is directed at the opposed outlet.

It will be appreciated that if the jets are sufficiently strong, the jets may drive the hair being dried against the screen 50. In such a case, an air moving member that produces suction may not be required or such an air moving member (e.g., motor and fan blade assembly 38) may act with the jets to draw the hair being dried against screen 50.

According to this embodiment, a combination of hair being drawn against screen 50 by suction and air, optionally hot air, being blown into the hair enhances the rate of hair drying without having to excessively heat the hair.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A hand held hair dryer having a longitudinally extending axis wherein the axis intersects a first side and an axially opposed second side, the hair dryer comprising:

(a) a primary air flow path extending from an inlet port provided on the first side of the hair dryer and extending to an outlet port;

(b) an air moving member provided in the primary air flow path;

(c) the inlet port comprises a screen, the screen is positioned upstream of the air moving member whereby ingress of hair into the inlet port of the primary air flow path is inhibited; and, (d) a water collection member located inward of the inlet port.

2. The hair dryer of claim 1 wherein the water collection member comprises a water absorbing member.

3. The hair dryer of claim 1 wherein the water collection member is removably mounted in the hair dryer.

4. The hair dryer of claim 2 wherein the water absorbing member comprises a sponge.

5. The hair dryer of claim 1 wherein the water collection member comprises a collection container with an openable outlet port.

6. The hair dryer of claim 1 wherein the outlet port is provided on the second side of the hair dryer.

7. The hair dryer of claim 1 wherein the air moving member comprises a motor and fan assembly that is operable in a high suction mode and in a high air flow mode.

8. The hair dryer of claim 7 wherein, in the high suction mode, a fan blade of the motor and fan assembly is in a high suction mode position in which the fan blade is positioned a first distance downstream from a fan blade cowling and, in the high air flow mode, the fan blade is in a high air flow mode positon in which the fan blade is positioned a second distance downstream from a fan blade cowling wherein the second distance is greater than the first distance.

9. The hair dryer of claim 8 further comprising a handle that is movingly mounted to the body, the handle is moveable from a high suction mode position to a high air flow mode position, the handle is drivingly connected to the fan and motor assembly whereby, as the handle is moved from the high suction mode position to the high air flow mode position, the fan blade is moved from the high suction mode position to the high air flow mode position.

10. The hair dryer of claim 1 further comprising a water discharge port, the water discharge port is positioned downstream from the water collection member and the air moving member.

11. The hair dryer of claim 1 further comprising a redirecting member operable between a first position in which a first volume of air travels from the primary inlet port to the primary outlet port and a second position in which at least some of the first volume of air is redirected to travel through a secondary air flow path having a secondary outlet port provided at the first side of the hair dryer.

12. The hair dryer of claim 11 wherein the secondary outlet port comprises a plurality of secondary air outlets positioned around the inlet port.

13. The hair dryer of claim 12 wherein the plurality of secondary air outlets direct air inwardly towards a center of the inlet port.

14. The hair dryer of claim 13 further comprising a heating element in the secondary air flow path.

15. The hair dryer of claim 14 further comprising an infrared heating element that, in operation, directs infrared heat to a location forward of the inlet port.

16. The hair dryer of claim 1 further comprising an infrared heating element that, in operation, directs infrared heat to a location forward of the inlet port.

17. The hair dryer of claim 14 further comprising a lighting member providing a first illumination effect when the air moving member is actuated and air is drawn in through the inlet port and a second illumination effect when the air moving member is actuated and air is drawn in through the inlet port and when the heating element is actuated.

18. The hair dryer of claim 15 further comprising a lighting member providing a first illumination effect when the air moving member is actuated and air is drawn in through the inlet port, a second illumination effect when the air moving member is actuated and air is drawn in through the inlet port and when the heating element in the secondary air flow path is actuated, and a third illumination effect when the air moving member is actuated and air is drawn in through the inlet port and when the infrared heating element is actuated.

19. The hair dryer of claim 16 further comprising a lighting member providing a first illumination effect when the air moving member is actuated and air is drawn in through the inlet port and a second illumination effect when the air moving member is actuated and air is drawn in through the inlet port and when the infrared heating element is actuated.

20. The hair dryer of claim 6 wherein the longitudinally extending axis intersects the air moving member.

* * * * *